US008016513B2

(12) United States Patent
Shin

(10) Patent No.: US 8,016,513 B2
(45) Date of Patent: Sep. 13, 2011

(54) APPARATUS FOR ABSORBING IMPACT OF VEHICLE COLLISION

(75) Inventor: Hyun-Soo Shin, Seoul (KR)

(73) Assignee: Kotrass Co., Ltd., Gyeonggi-Do (KR)

( * ) Notice: Subject to any disclaimer, the term of this patent is extended or adjusted under 35 U.S.C. 154(b) by 39 days.

(21) Appl. No.: 12/593,761

(22) PCT Filed: Jan. 17, 2008

(86) PCT No.: PCT/KR2008/000289

§ 371 (c)(1),
(2), (4) Date: Sep. 29, 2009

(87) PCT Pub. No.: WO2008/143393

PCT Pub. Date: Nov. 27, 2008

(65) Prior Publication Data

US 2010/0080652 A1 Apr. 1, 2010

(30) Foreign Application Priority Data

May 21, 2007 (KR) ..... 10-2007-0048976

(51) Int. Cl.
*E01F 15/00* (2006.01)

(52) U.S. Cl. ..... 404/6

(58) Field of Classification Search ..... 404/6, 9, 404/10

See application file for complete search history.

(56) References Cited

U.S. PATENT DOCUMENTS

| | | | | |
|---|---|---|---|---|
| 4,583,716 | A * | 4/1986 | Stephens et al. | 256/13.1 |
| 4,674,911 | A | 6/1987 | Gertz | |
| 4,815,565 | A * | 3/1989 | Sicking et al. | 404/6 |
| 5,022,782 | A * | 6/1991 | Gertz et al. | 404/6 |
| 5,660,496 | A * | 8/1997 | Muller et al. | 404/6 |
| 6,179,516 | B1 * | 1/2001 | Ivey et al. | 404/6 |
| 6,905,281 | B2 * | 6/2005 | Kang | 404/6 |
| 6,962,245 | B2 * | 11/2005 | Ray et al. | 188/377 |
| 7,168,880 | B2 * | 1/2007 | Kennedy et al. | 404/6 |
| 7,396,184 | B2 * | 7/2008 | La Turner et al. | 404/6 |

FOREIGN PATENT DOCUMENTS

| | | | |
|---|---|---|---|
| JP | 09-329172 | A | 12/1997 |
| KR | 10-2006-0065554 | A | 6/2006 |
| KR | 20-0424297 | Y1 * | 8/2006 |

* cited by examiner

*Primary Examiner* — Raymond W Addie
(74) *Attorney, Agent, or Firm* — Arent Fox, LLP

(57) ABSTRACT

An apparatus for absorbing the impact of a vehicle collision is disclosed. The apparatus includes a partition moving speed control member (10), which is provided in the frontmost partition, and a guide rod (20), which is inserted into a hole (10*a*) in the member (10), such that the front end of the guide rod is fastened to rails, and the rear end of the guide rod does not reach the rearmost partition. The apparatus further includes a locking rod (120), which is coupled to the guide rod (20) such that the rear end of the locking rod (120) is placed through the rearmost partition, and a locker, which is provided on the rearmost partition so that, when the vehicle collision occurs, the locking rod freely passes over the locker, but, after the vehicle collision is finished, the locking rod is prevented from being returned to the original position thereof.

14 Claims, 36 Drawing Sheets

APPARATUS FOR ABSORBING IMPACT OF VEHICLE COLLISION

CROSS-REFERENCE TO RELATED APPLICATION

This application is a National Stage entry of International Application No. PCT/KR2008/000289, filed Jan. 17, 2008, which claims priority to Korean Patent Application No. 10-2007-0048976, filed May 21, 2007, the disclosure of the prior applications is hereby incorporated in its entirety by reference.

TECHNICAL FIELD

The present invention relates, in general, to apparatuses for absorbing the impact of vehicle collisions using scrap tires and, more particularly, to an apparatus for absorbing the impact of a vehicle collision which is placed, for example, on an on/off ramp, and is constructed such that, when a vehicle collides with the impact absorbing apparatus, the movement of partitions for absorbing impact is stopped in a braking manner, thus effectively absorbing the impact of the vehicle collision, and minimizing damage to the impact absorbing apparatus, thereby making it possible to reuse the apparatus.

BACKGROUND ART

As well known, according to the rapid increase in traffic volume due to economic growth and increased income, and according to the tendency toward high-speed road traffic due to the improvement in the performance of vehicles, the incidence of traffic accidents has increased. As well, the scale of a traffic accident has also increased, thus resulting in enormous national and social loss. Furthermore, according to statistics, the number of single-vehicle accidents has rapidly increased. Therefore, the maintenance of roadside equipment and the installation of protective structures are required, as has been demonstrated by the results of extensive research.

A guard rail and an impact absorbing apparatus, which is provided in front of the guard rail to absorb the impact of vehicle collision, are representative examples of such protective structures.

The guard rails are installed on both sides of a road or on the central line of the road and thus define the width of the road, within which vehicles travels. In addition, when a vehicle undesirably moves off the road, the guard rails serve to protect passengers and the vehicle from dangers present beside the road, and guide the vehicle in a direction in which the vehicle can remain safe, in order to prevent a chain accident involving following vehicles and thus prevent the passengers and the vehicles from being injured and damaged. The vehicle collision impact absorbing apparatuses for roads are installed in front of the guard rails or concrete structures and serve to absorb the impact when vehicles collide with the guard rails or the concrete structures.

However, in the case of the vehicle collision impact absorbing apparatuses according to conventional techniques, because they are constructed such that only about five to ten scrap tires, which are tied together, are placed in front of a guard rail or a concrete structure, there is a problem in that secondary safety hazards may be induced.

That is, because the scrap tires are merely placed in front of the guard rail or the concrete structure and are not fixed thereto, when a vehicle collision occurs, the scrap tires may fly away from their original positions and impede the travel of other vehicles. Furthermore, the material of the scrap tires is unsuitable for slowly absorbing impacts. Hence, even if the scrap tires are fixed to the guard rail or the concrete structure, there is a problem in that the vehicle may rebound from the scrap tires, with the result that it collides with another vehicle.

In an effort to overcome the problems experienced with the conventional techniques, a vehicle collision impact absorbing apparatus, which uses scrap tires and is constructed such that, when a vehicle collision occurs, a front partition is moved backwards and an anchor thereof is locked to a locking slot of a ladder, so that the ladder is prevented from being moved in the reverse direction by the restoring force of the scrap tires, was proposed in Korean Utility Model Registration Nos. 390585 and 412263, which was filed by the applicant of the present invention and has been registered. This technique will be briefly explained herein below with reference to FIGS. 1 and 2.

As shown in FIG. 1, in the vehicle collision impact absorbing apparatus according to these techniques, two rails 1 are fixed to the ground using anchor bolts (not shown). A ladder 2, which has therein slots 2*a* formed at positions spaced apart from each other at regular intervals, is provided between the rails. Support guides 3*a*, which are provided on the lower ends of partitions 3, are inserted into the respective rails 1. As shown in FIG. 2, scrap tires 4 are interposed between the adjacent partitions 3. As seen in FIG. 2, the rightmost partition 3 is disposed on the right ends of the rails 1 and is supported by a support plate 3*b* such that it is prevented from being pushed off of the right ends of the rails 1.

As shown in FIGS. 1 and 2, an anchor 3*c* is provided on the lower end of each of the first and second partitions 3, counting from the left end of the rails. Thus, when a vehicle collision occurs, the anchors are locked to corresponding slots 2*a* of the ladder 2. The functions of the ladder 2, the anchors 3*c*, the scrap tires 4 and openings 4*a*, which are shown in FIGS. 1 and 2, are described in detail in Korean Utility Model Registration Nos. 367001, 376121 and 390585, which were filed by the applicant of the present invention, therefore further explanation will be skipped.

Referring to FIG. 1, locking holes 2*b* are formed on opposite positions of the slot 2*a*, which is formed through the rear end of the ladder 2, so that locking parts of catches 5*a* of a ladder holding device 5 are inserted into and locked to the respective locking holes 2*b*. The detailed explanation of the ladder holding device 5 and a roller 6 will be skipped, because it was provided in detail in Korean Utility Model Registration No. 412263.

However, in the conventional vehicle collision impact absorbing apparatus having the above-mentioned construction, because a relatively large collision force is applied from the left of FIG. 2 to the partitions 3 when a vehicle collides with the apparatus, even though the scrap tires 4 are used, the impact absorbing apparatus cannot satisfactorily absorb the momentary force.

In other words, even though the contractile force of the scrap tires is used, when a relatively large momentary force is applied to the impact absorbing apparatus, the partitions 3 are moved backwards too rapidly. Thereby, the impact absorbing apparatus itself may become damaged, thus becoming useless.

Therefore, a structure in which, when a vehicle collision occurs, partitions can slowly move to satisfactorily absorb the collision force of the vehicle, rather than moving rapidly, is required.

Furthermore, in the technique of FIG. 1, the ladder holding device 5 is constructed such that, after the vehicle collision occurs, the ladder 2 is released from the ladder holding device 5 by manually rotating a lever 7, which is integrated with a shaft rod 7*a*, and the scrap tires 4, which have been contracted, are thus returned to the original positions thereof. However, in the case where the impact absorbing apparatus is disposed on a shoulder of a road, anybody can easily touch the lever 7. Therefore, there is a problem in that, after a vehicle collision occurs, if somebody touches the lever 7 without caution so that the scrap tires are abruptly returned to the original positions thereof, another safety hazard may result.

To solve these problems, a vehicle collision impact absorbing apparatus using a guide rod and a braking means was proposed in Korean Utility Model Registration No. 424297, which was filed by the applicant of the present invention and has been registered. This technique will be briefly explained herein below.

The impact absorbing apparatus of Korean U.M. Registration No. 424297 has the construction shown in FIG. 3. In FIG. 3, the same reference numerals as those of FIG. 1 denote corresponding parts, therefore further explanation of those parts will be skipped.

As can be understood from FIG. 3, a partition moving speed control member 10, which has an inner hole 10*a* having a predetermined inner diameter, is fastened to a frontmost partition 3, which is disposed at the frontmost position, with which a vehicle collides, using bolts 11 shown in FIG. 4. The guide rod 20 is inserted into the inner hole 10*a* of the partition moving speed control member 10. The front end of the guide rod 20 is fastened to the front ends of rails 1. A guide rod insert hole 31 for insertion of the guide rod 20 and bolt insert holes 31 for insertion of the bolts 11 are formed through the partition 3 for installation of the guide rod 20.

As shown in FIG. 4, the front end of the guide rod 20 is curved and fastened to an inclined plate 40, which is provided on the front ends of the rails 1, using brackets 41 and 42 and a bolt 43. A plurality of through holes is formed through each of the bracket 43 and the inclined plate 40. As shown in the enlarged view of FIG. 3, a bolt hole 42*a* is formed in the bracket 42.

FIG. 5 illustrates a tool 50, which is used to release the ladder holding device 5 from locking holes 2*b* of the ladder 2 after a vehicle collision occurs and thus restore the scrap tires 4, which have been contracted when the vehicle collision occurs. Two coupling holes 7*b* are formed in a shaft rod 7*a* of the ladder holding device 5, and two coupling protrusions 50*a*, which are inserted into the respective coupling holes 7*b*, are provided on the tool 50. Therefore, when it is desired to release the ladder holding device 5, the coupling protrusions 50*a* of the tool 50 are inserted into the respective coupling holes 7*b*, and the tool 50 is thereafter rotated, thus rotating the ladder holding device 5.

Referring to FIG. 6, the vehicle collision impact absorbing apparatus can be installed, for example, on an on/off ramp of a road. FIG. 7 is a sectional view illustrating the impact absorbing apparatus, which is installed as explained above.

As shown in FIG. 7, the guide rod 20 extends from the first partition, counting from the left ends of the rails, to the third partition. That is, in the impact absorbing apparatus, because the scrap tires 4 are not completely contracted from the front surface (the leftmost end) thereof to the rear surface thereof, the length of the guide rod 20 is less than that of the impact absorbing apparatus.

In a state in which the impact absorbing apparatus is installed on the on/off ramp, when a vehicle collides with the impact absorbing apparatus in the direction of the arrow of FIG. 8, the scrap tires 4 are contracted. At this time, air present in the scrap tires 4 is discharged outside through openings 4*a*. Simultaneously, inclined parts of anchors 3*c*, which are provided on the lower ends of the first and second partitions 3, counting from the left in FIG. 3, consecutively pass over several slots 2*a* of the ladder 2. The intensity of this process is determined by the collision force of the vehicle.

Thereafter, when the vehicle that collides with the impact absorbing apparatus is stopped, locking surfaces of the anchors 3*c* are locked to the corresponding slots 2*a*, so that the scrap tires 4 maintain the contracted state, as shown in FIG. 9. Therefore, this technique can prevent the vehicle or a person from being secondarily damaged or injured by secondary movement (expansion after contraction) of the scrap tires 4.

However, the technique of Korean U.M. Registration No. 424297 can absorb some impact, but there may be a severe defect when it is implemented at a desired place.

In detail, in this technique, as shown in FIG. 7, the guide rod 20 does not extend to the rearmost partition when the impact absorbing apparatus is initially installed (before a vehicle collides therewith). Thus, when a vehicle collision occurs, as shown in FIG. 9, while the partition moving speed control member 10 moves along the guide rod 20, the guide rod 20 is lengthened by a distance corresponding to a portion 20*a*, that is, by approximately 150 mm to 200 mm. At this time, the guide rod 20 may be stuck to one of the medial partitions and thus break.

In this case, it is not easy to return the partitions to the original positions thereof after clearing up the vehicle collision. Therefore, there is a problem in that it is very difficult to return the impact absorbing apparatus to the original state thereof to reuse it.

DISCLOSURE OF INVENTION

Technical Problem

Accordingly, the present invention has been made keeping in mind the above problems occurring in the prior art, and an object of the present invention is to provide an apparatus for absorbing the impact of a vehicle collision, in which a guide rod is fastened at a first end thereof to the front ends of rails, and a second end thereof, that is, a free end thereof, is freely movably inserted into an insert hole, which is formed through a rearmost partition, thus preventing the part of the guide rod that is extended by a partition moving speed control member when a vehicle collides with the impact absorbing apparatus from striking a partition, thereby reliably ensuring the restoration of the impact absorbing apparatus and the correct operation thereof.

Another object of the present invention is to provide an apparatus for absorbing the impact of a vehicle collision which is constructed such that the expansive force of contracted scrap tires can be effectively restrained, despite having neither a ladder nor a ladder holding device for preventing the partitions from undesirably moving after the vehicle collision is finished.

A further object of the present invention is to provide an apparatus for absorbing the impact of a vehicle collision which may be constructed such that the movement of the partitions for absorbing impact is effectively stopped in a braking manner without using the ladder, an anchor or scrap tires, which are provided between the partitions, thus efficiently absorbing the impact of the vehicle collision.

Technical Solution

In order to accomplish the above objects, in a first embodiment, the present invention provides an apparatus for absorbing an impact of a vehicle collision, including: a plurality of partitions, between which scrap tires are arranged in a line, each of the scrap tires having a plurality of openings in a circumferential outer surface thereof, the plurality of partitions being moved along rails in a direction in which the scrap tires are compressed; an anchor provided on a lower end of each of some partitions among the plurality of partitions, so that, when the vehicle collision occurs, the anchor is elastically locked to a ladder, provided between the rails; and a ladder holding device for holding the ladder to prevent the ladder from being moved before the vehicle collision occurs, the ladder holding device being releasable in a manual manipulation manner to expand the scrap tires, which are contracted, after the vehicle collision is over, the apparatus comprising: a partition moving speed control member provided in the partition, disposed at a frontmost position, with which a vehicle collides, the partition moving speed control member having therein an inner hole having a predetermined inner diameter; and a guide rod inserted into the inner hole of the partition moving speed control member, wherein a front end of the guide rod is fastened to front ends of the rails, and a free rear end of the guide rod is provided through an insert hole, which is formed through the partition, disposed at a rearmost position, so that a part of the guide rod that is extended when the partition moving speed control member is advanced along the guide rod is prevented from being bent by striking one of the partitions.

The partition moving speed control member may have a double structure using a high strength insert, a front inner surface of which is rounded, and a rear inner surface of which is inclined at a predetermined angle.

In a second embodiment, the present invention provides an apparatus for absorbing an impact of a vehicle collision, including a plurality of partitions, between which scrap tires are arranged in a line, each of the scrap tires having a plurality of openings in a circumferential outer surface thereof, the plurality of partitions being moved along rails in a direction in which the scrap tires are compressed, the apparatus comprising: a partition moving speed control member provided in the partition, disposed at a frontmost position, with which a vehicle collides, the partition moving speed control member having therein an inner hole having a predetermined inner diameter; a guide rod inserted into the inner hole of the partition moving speed control member, such that a front end of the guide rod is fastened to front ends of the rails, and a free rear end of the guide rod does not reach the partition disposed at a rearmost position; a locking rod coupled to the free rear end of the guide rod such that a free rear end of the locking rod is placed through the rearmost partition, the locking rod having conical body parts and stop parts; and a locker provided on an outer surface of the rearmost partition, through which the locking rod is placed, such that, when the vehicle collision occurs, the locking rod freely passes over the locker, and, after the vehicle collision is over, the locking rod is prevented from being returned to an original position thereof by an expansive force of the scrap tires.

In the second embodiment, the locking rod may have an internal thread tap on a front end thereof, so that the locking rod is removably coupled to an external thread, formed in the guide rod, in a rotating manner, and the free rear end of the locking rod may have a predetermined cross-section facilitating handling of the locking rod to return the partitions to the original positions thereof after the vehicle collision is finished.

The cross-section of the free rear end of the locking rod may have one shape selected from among a triangular shape, a rectangular shape and a pentagonal shape to enable easy rotation of the locking rod to release the guide rod from the locking rod.

Preferably, the locker may include: a locker body fastened to the outer surface of the rearmost partition, the locker body having a through hole, into which the locking rod is inserted, a depression and a plurality of internal thread holes; a slider provided in the depression so as to be slidable, the slider having an open inclined part for allowing advancement of the locking rod, and a locking part for preventing the advanced locking rod from being moved in reverse; an elastic member for providing elastic force to the slider; a support plate fastened to the locker body to prevent the elastic member from being removed from the locker body; and a slider stroke adjustment member provided through the support plate to adjust a range of a movement stroke of the slider.

Furthermore, the locker may be constructed such that two sliders, two elastic members, two support plates and two slider stroke adjustment members are provided in a single locker body.

In the second embodiment, the apparatus may further comprise a locking rod separating tool for releasing the guide rod from the locking rod to return the scrap tires, which are contracted by the vehicle collision, to original positions thereof after the vehicle collision is finished.

In a third embodiment, the present invention provides an apparatus for absorbing an impact of a vehicle collision, including a plurality of partitions to be moved along rails when a vehicle collides therewith, the apparatus comprising: a plurality of partition moving speed control members provided in the partition, disposed at a frontmost position, with which the vehicle collides, each of the plurality of partition moving speed control members having a double structure comprising a high strength insert, a front inner surface of which is rounded, and a rear inner surface of which is inclined at a predetermined angle; a guide rod inserted into an inner hole of each of the partition moving speed control members, wherein front ends of the guide rods are fastened to front ends of the rails, and free rear ends of the guide rods are provided through respective insert holes, which are formed through the partition disposed at a rearmost position, so that, when the vehicle collision occurs, the partition moving speed control members are advanced along the respective guide rods to absorb the impact of the vehicle collision; and a plurality of covers provided on upper ends of the partitions, the covers being movable backwards along with the partitions when the vehicle collision occurs.

In the third embodiment, the partition moving speed control members may comprise: at least two partition moving speed control members provided in the frontmost partition and provided on each of the guide rods in series so as to be movable along the guide rod. The at least two partition moving speed control members may have inner diameters different from each other. Of the partition moving speed control members provided on each of the guide rods in series, the partition moving speed control member that is disposed at a rear position may have an inner diameter greater than an inner diameter of the partition moving speed control member that is disposed at a front position.

Preferably, the apparatus for absorbing the impact of the vehicle collision may further comprise a partition moving speed control member provided in at least one partition of the partitions other than the frontmost partition.

Hereinafter, the present invention will be described in detail with reference to the attached drawings.

FIG. 10 is an exploded perspective view illustrating the critical parts of an apparatus for absorbing the impact of a vehicle collision, according to a first embodiment of the present invention. In FIG. 10, the same reference numerals as those of FIG. 3 denote corresponding parts, therefore further explanation will be skipped, and only characteristic parts of the present invention will be described.

As shown in FIG. 10, a partition moving speed control member 10, which has an inner hole having a predetermined inner diameter, is fastened to a frontmost partition 3, which is disposed at the frontmost position, at which it collides with a vehicle.

As can be appreciated from FIG. 11, the front inner surface of the partition moving speed control member 10 is rounded, and the rear inner surface thereof is inclined at a predetermined angle, such that, when the frontmost partition is moved when the vehicle collides therewith, the partition moving speed control member 10 can be smoothly moved along a guide rod 20. For this, it is preferable that the partition moving speed control member 10 be manufactured to have a double structure using a high strength insert 10*b*, the front inner surface of which is rounded, and the rear inner surface of which is inclined at a predetermined angle.

Furthermore, a guide rod insert hole 31 for insertion of the guide rod 20 and bolt insert holes 31 for insertion of bolts 11 are formed through the partition 3 for installation of the guide rod 20.

As shown in FIG. 17, when no vehicle collides with the impact absorbing apparatus, the guide rod 20 is fastened at a first end thereof to the front ends of rails 1, and a second end thereof, that is, a free end thereof, is freely movably inserted into the insert hole 3*c*, which is formed through the rearmost partition. As shown in FIG. 19, when a vehicle collides with the impact absorbing apparatus, the partition moving speed control member 10 pushes the guide rod 20 and moves backwards, so that the guide rod 20 is extended to a predetermined length, as described above. Here, the extended length of the guide rod 20 protrudes rightwards through the insert hole 3*c* of the rearmost partition. Therefore, there is an advantage in that it is easy to reuse the impact absorbing apparatus after clearing up the collision.

FIG. 20 illustrates a second embodiment of the present invention. The second embodiment has a construction in which a ladder and a ladder holding device are removed from the construction of the first embodiment. In other words, the second embodiment of the present invention is constructed such that, although it does not have the ladder and the ladder holding device for preventing partitions from moving after the vehicle collision is finished, the expansive force of scrap tires, which have been contracted, can be effectively restricted.

When comparing the case of FIG. 20 to the case of FIG. 3, it will be appreciated that the case of FIG. 20 does not require the ladder 2 or the ladder holding device 5.

In detail, in the second embodiment of the present invention, as shown in FIGS. 20 through 22, a partition moving speed control member 10, which has an inner hole 10*a* having a predetermined inner diameter, is provided in the frontmost partition 3, which is disposed at the frontmost position, with which a vehicle collides. A guide rod 20 is inserted into the inner hole 10*a* of the partition moving speed control member 10. The front end of the guide rod 20 is fastened to the front ends of the rails 1, but the free rear end thereof does not extend to the rearmost partition. A locking rod 120, which includes conical body parts 121 and stop parts 122, is connected to the rear end of the guide rod 20. The free end of the locking rod 120 passes through the rearmost partition. Furthermore, a locker 130 is provided on the outer surface of the rearmost partition, through which the locking rod 120 passes. The locker 130 has a structure such that, when a vehicle collides with the impact absorbing apparatus, the locking rod 120 can freely pass over the locker 130, but, after the collision is finished, the locking rod 120 can be prevented from being returned to the original position thereof by the expansive force of the scrap tires.

As shown in FIG. 24, the locking rod 120 has an internal thread tap 123 on the front end thereof, so that the locking rod 120 is removably coupled to an external thread 20*a*, formed in the guide rod 20, by rotating them with respect to each other. The rear end of the locking rod 120 has a predetermined cross-section facilitating handling of the locking rod to return the partitions to the original positions thereof after the collision is finished. That is, the cross-section of the rear end of the locking rod 120 may have one shape selected from among a triangular shape, a rectangular shape and a pentagonal shape, to make it easy to rotate the locking rod 120 to release the guide rod 20 from the locking rod 120.

Referring to FIG. 23, the locker 130 includes a locker body 131, which is fastened to the outer surface of the rearmost partition. The locker body 131 has a through hole 131*a*, into which the locking rod 120 is inserted, a depression 131*b* and a plurality of internal thread holes 131*c*. The locker 130 further includes a slider 132, which is movably provided in the depression 131*b*. The slider 132 includes an open inclined part 132*a*, which allows advancement of the locking rod 120, and a locking part 132*b*, which prevents the locking rod 120, which has been advanced, from being moved in reverse. The locker 130 further includes an elastic member 133, which provides elastic force to the slider 132, a support plate 134, which is fastened to the locker body 131 to prevent the elastic member 133 from being undesirably removed from the locker body 131, and a slider stroke adjustment member 135, which is placed through the support plate 134 to adjust the range of the stroke of the slider 132.

The installation and operation of the second embodiment, having the above-mentioned construction, will be explained herein below.

As shown in FIG. 20, the locker 130 is fastened to the outer surface of the rearmost partition 3*a* using a plurality of bolts 140. The partitions 3 are inserted into the rails 1 in a slide coupling manner. Thereafter, as shown in FIG. 24, the locking rod 120 is coupled to the rear end of the guide rod 2. As shown in FIGS. 22 and 23, the locking rod 120 is disposed such that the free end thereof passes through the rearmost partition and the locker 130, thus completing the assembly of the impact absorbing apparatus.

Here, as can be understood from FIG. 27, the conical body parts 121 of the locking rod 120 are easily movable in the arrow direction through the open inclined part 132*a* of the slider 132. Furthermore, the slider 132 is biased downwards by the elastic force of the elastic member 133, so that the locking part 132*b* of the slider 132 engages with one stop part (vertical part) 121 of the locking rod 120, thus preventing the locking rod 120 from being moved in the direction opposite the direction of the arrow of FIG. 27.

In the state in which the impact absorbing apparatus of the present invention is installed through the above-mentioned process, as shown in FIGS. 25 and 26, when a vehicle collides with the impact absorbing apparatus in the direction of the arrow, the partition moving speed control member 10 is moved along the guide rod 20, and, simultaneously, the guide rod 20 itself is extended. As shown in FIG. 28, the guide rod 20 is also advanced in the direction of the arrow. At this time, the slider 132 and the elastic member 133 are elastically pushed upwards.

Thereafter, after the collision is finished, the partitions are biased in the direction in which they are returned to the original positions thereof by the expansive force of the scrap tires. At this time, as shown in FIG. 29, the slider 132 and the elastic member 133 are moved in the direction of the arrow, that is, downwards. Thus, the locking part 132*b* of the slider 132 is locked to the corresponding stop part 122 of the locking rod 120. As a result, the locking rod 120 is prevented from being removed from the locker 130, and maintains the locked state.

Meanwhile, after the collision is over, the impact absorbing apparatus of the present invention must be returned to the original state thereof. The process for this will be described herein below.

As shown in FIG. 30, when it is desired to return the impact absorbing apparatus to the original state thereof, a tool 150 is fitted over the rear end of the locking rod 120 and is rotated, as shown in FIG. 31. Then, the locking rod 120 is separated from the guide rod 20 (refer to FIG. 32). At this time, as shown in FIG. 15, the partition moving speed control member 10 is moved to the original position thereof along the guide rod 20, so that the partitions are rapidly returned to the original positions thereof by the expansive force of the scrap tires.

As described above, the second embodiment of the present invention is advantageous in that it can be very precisely operated using the locker 130 and the locking rod 120, despite having neither a ladder nor a ladder holding device.

FIGS. 33 through 37 illustrate a modification of the locker 130. A locker 230 according to the modification includes a locker body 231, which is fastened to the outer surface of the rearmost partition. The locker body 231 has a through hole 231*a*, into which the locking rod 120 is inserted, a depression 231*b* and a plurality of internal thread holes 231*c*. The locker 230 further includes two sliders 232, which are movably provided in the depression 231*b*. Each slider 232 includes an open inclined part 232*a*, which allows advancement of the locking rod 120, and a locking part 232*b*, which prevents the locking rod 120, which has been advanced, from being moved in reverse. The locker 230 further includes two elastic members 233, which provide elastic force to the respective sliders 232, two support plates 134, which are fastened to the locker body 231 to prevent the respective elastic member 233 from being undesirably removed from the locker body 231, and slider stroke adjustment members 235, which are placed through the respective support plates 234 to adjust ranges of the movement strokes of the respective sliders 232. The general construction of the modification, with the exception of the structure of the locker, remains the same as the second embodiment.

In the case where the impact absorbing apparatus of the present invention is relatively large, the locker 230 is useful.

FIG. 38 is a partially exploded perspective view of an apparatus for absorbing the impact of a vehicle collision, according to a third embodiment of the present invention. Unlike the first and second embodiments, the third embodiment has no scrap tires but uses only partition moving speed control members 10 and guide rods 20. Therefore, the third embodiment has only a function of absorbing the impact of a vehicle collision, without having any restoring ability.

In practice, the impact absorbing apparatus according to the third embodiment proposed by the applicant of the present invention passed a crash test conduced by the Highway & Transportation Technology Institute, Korea Highway Corporation. As such, the third embodiment can satisfactorily absorb the impact of a vehicle collision using only the partition moving speed control members 10 and the guide rods 20, despite having no scrap tires, ladder or anchor, unlike the first and second embodiments.

Referring to FIGS. 38 and 39, the impact absorbing apparatus according to the third embodiment of the present invention includes a plurality of partitions 3, which are moved along rails 1. The two partition moving speed control members 10 are provided in the frontmost partition. The two guide rods 20 are inserted into respective inner holes 10*a*, which are formed through the two respective partition moving speed control members 10. The front ends of the guide rods 20 are fastened to the front end of the rails 1, and the rear ends, that is, the free ends, of the guide rods 20 are inserted into respective insert holes 3*c*, which are formed though the rearmost partition. When a vehicle collides with the impact absorbing apparatus, the partition moving speed control members 10 are advanced along the respective guide rods 20 to absorb the impact of the vehicle collision.

Furthermore, a plurality of covers 500, which are movable backwards along with the partitions 3 when the vehicle collision occurs, is provided on the upper ends of the partitions 3. The front end of each cover 500 is fastened to the corresponding partition using screws (not shown). Several slots 500*b* are formed through the front end of each cover 500. Bent pieces 500*a* are formed in the rear end of each cover 500. Under normal conditions, the bent pieces 500*a* are in a state in which they are inserted in the respective slots 500*b* of the adjacent cover 500. When a vehicle collision occurs, the bent pieces 500*a* are removed from the corresponding slots 500*b* by the movement of the partitions.

The third embodiment of the present invention, having the above-mentioned construction, is operated in the manner shown in FIGS. 40 and 41, thus effectively absorbing the impact of the vehicle collision. The general operation of the third embodiment, with the exception of the fact that it has no scrap tires, is similar to those of the first and second embodiments, therefore further explanation is deemed unnecessary.

As shown in FIGS. 40 and 41, it is to be appreciated that, because there are no scrap tires, the third embodiment has only the function of absorbing the impact transmitted from the vehicle, without having restoring ability.

FIG. 42 illustrates a modification of the partition moving speed control member 10, which is provided in the frontmost partition. According to this modification, at least two partition moving speed control members 10 are provided on each guide rod in series so as to be movable along the guide rod. The two partition moving speed control members 10 have inner diameters which are different from each other. Of the two partition moving speed control members 10, which are provided on each guide rod in series, the partition moving speed control member 10, which is disposed at the rear position, has an inner diameter greater than that of the partition moving speed control member 10, which is disposed at the front position, thus realizing a double impact absorbing structure.

As such, the third embodiment is constructed such that the function of absorbing impact of the vehicle collision is conducted using only the partition moving speed control members 10 and the guide rods 20, without using the scrap tires, the ladder 2 or the anchor 3*c*. Therefore, although the third embodiment has no restoring ability, there is an advantage in that the cost of manufacturing the impact absorbing apparatus can be reduced.

As described above, an apparatus for absorbing the impact of a vehicle collision according to the present invention is constructed such that, when a vehicle collides with the impact absorbing apparatus, the movement of partitions for absorbing impact is stopped in a braking manner, thus effectively absorbing the impact of the vehicle collision, and minimizing damage to the impact absorbing apparatus, thereby making it possible to reuse the apparatus.

Furthermore, the present invention may be constructed such that the expansive force of contracted scrap tires can be effectively restrained, despite having neither a ladder nor a ladder holding device for preventing the partitions from undesirably moving after the collision is finished.

In addition, the present invention may be constructed such that the function of absorbing the impact of the vehicle collision is conducted using only partition moving speed control members and the guide rods, without using the scrap tire, the ladder or an anchor. In this case, although the impact absorbing apparatus has no restoring ability, there is an advantage in that the cost of manufacturing the impact absorbing apparatus can be reduced. Therefore, the present invention can be easily adapted to various installation conditions at an installation site and meet the needs of consumers, thus being very useful.

Although the preferred embodiments of the present invention have been disclosed with reference to the drawings, the present invention is not limited to those embodiments, but various modifications, additions and substitutions are possible, without departing from the scope and spirit of the invention as disclosed in the accompanying claims.

For example, although it is preferable that the partition moving speed control member 10 be provided in the frontmost partition, it may be provided in at least one of the partitions other than the frontmost partition. Furthermore, depending on the length of the impact absorbing apparatus, an additional partition moving speed control member may be provided in a partition, which is disposed at a medial position, in addition to the partition moving speed control member provided in the frontmost partition. As one example, in the case where there are seven partitions, a partition moving speed control member 10 may be provided in each of the frontmost partition (the first partition), and fourth and fifth partitions.

DESCRIPTION OF THE ELEMENTS IN THE DRAWINGS

Figure 1:
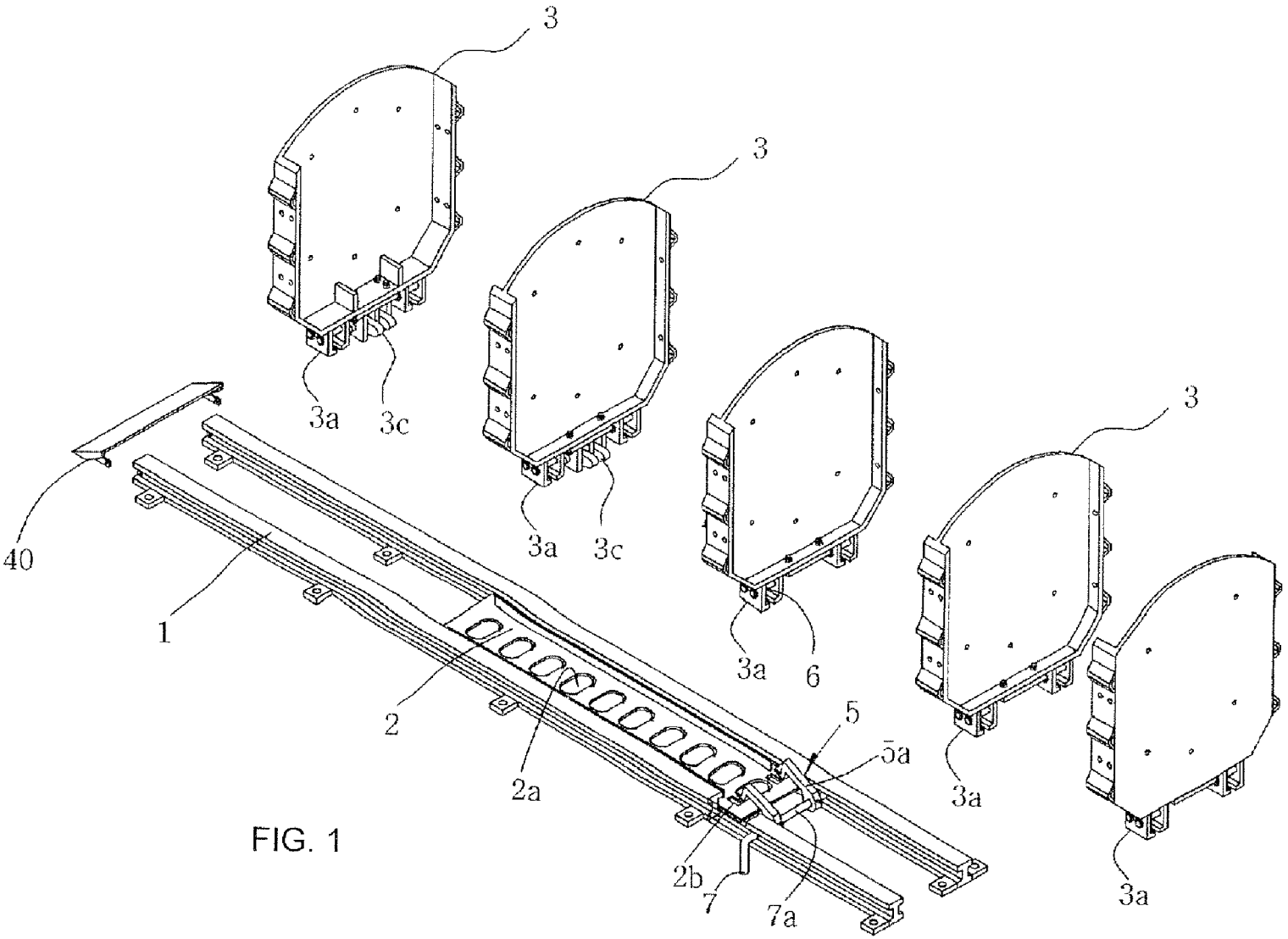
FIG. 1 is an exploded perspective view showing critical parts of an apparatus for absorbing the impact of a vehicle collision, according to a conventional technique.
Figure 2:
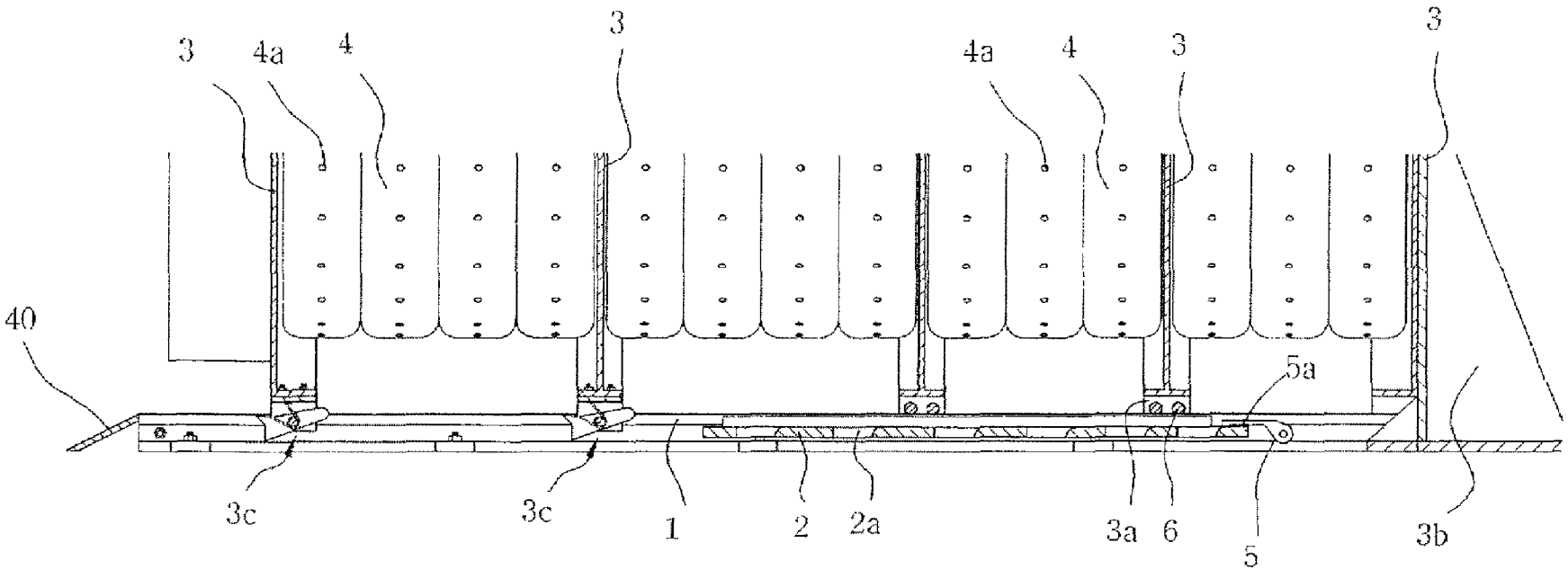
FIG. 2 is a side sectional view of the impact absorbing apparatus, which is provided on an on/off ramp, and in which scrap tires are interposed between partitions of FIG. 1.
Figure 3:
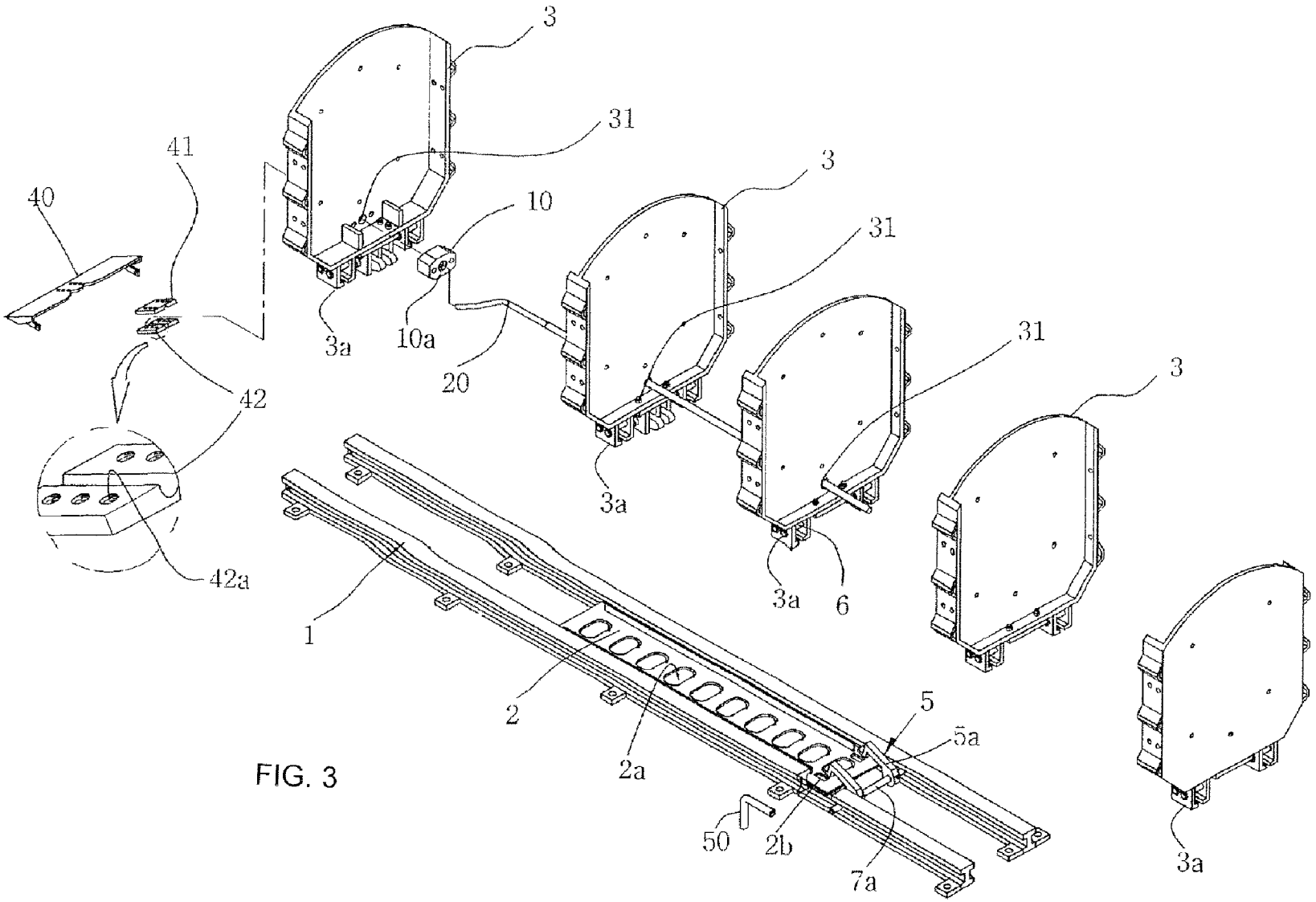
FIG. 3 is an exploded perspective view showing the critical parts of an apparatus for absorbing the impact of a vehicle collision, according to another conventional technique.
Figure 4:
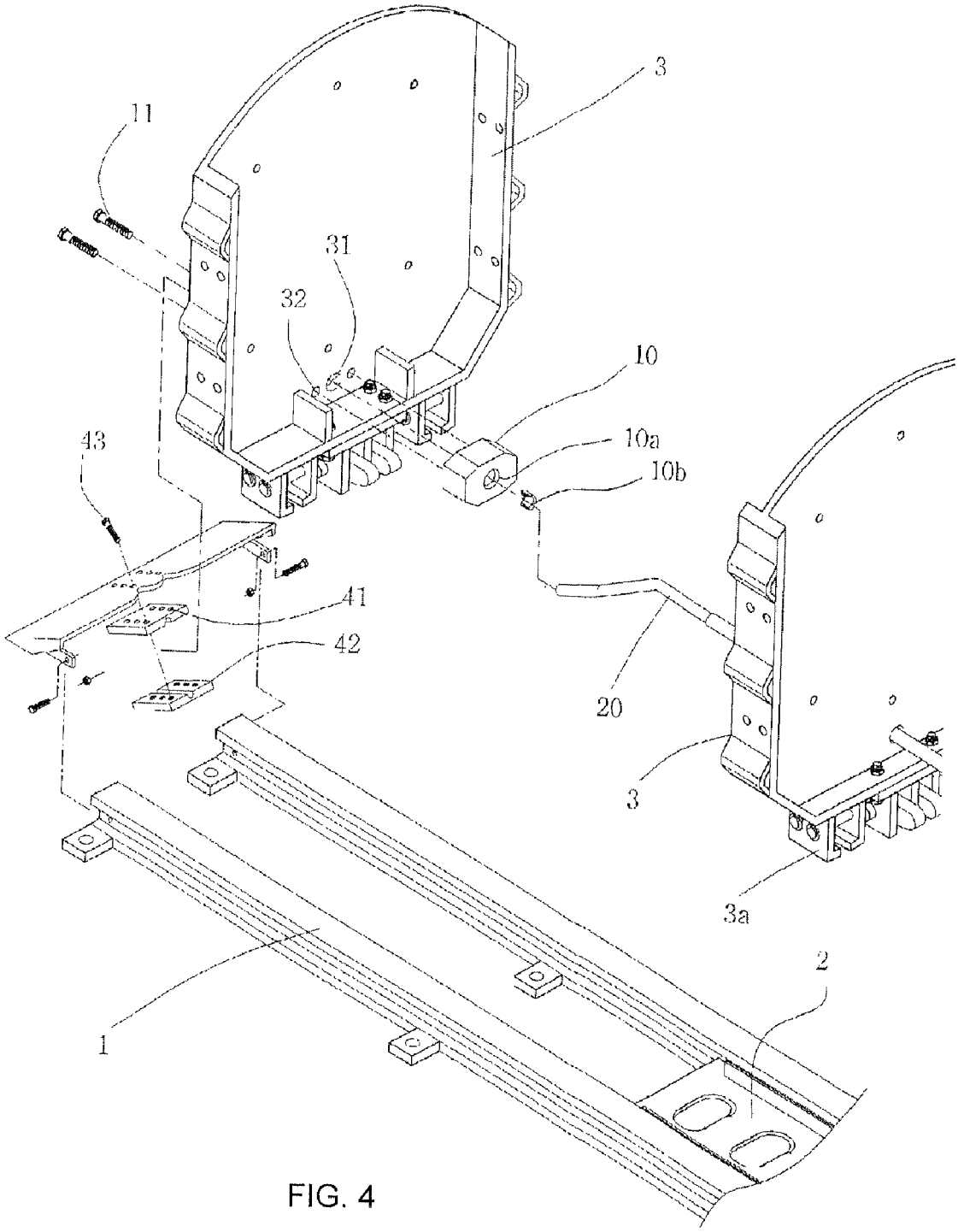
FIG. 4 is an enlarged view showing a critical part of FIG. 3.
Figure 5:
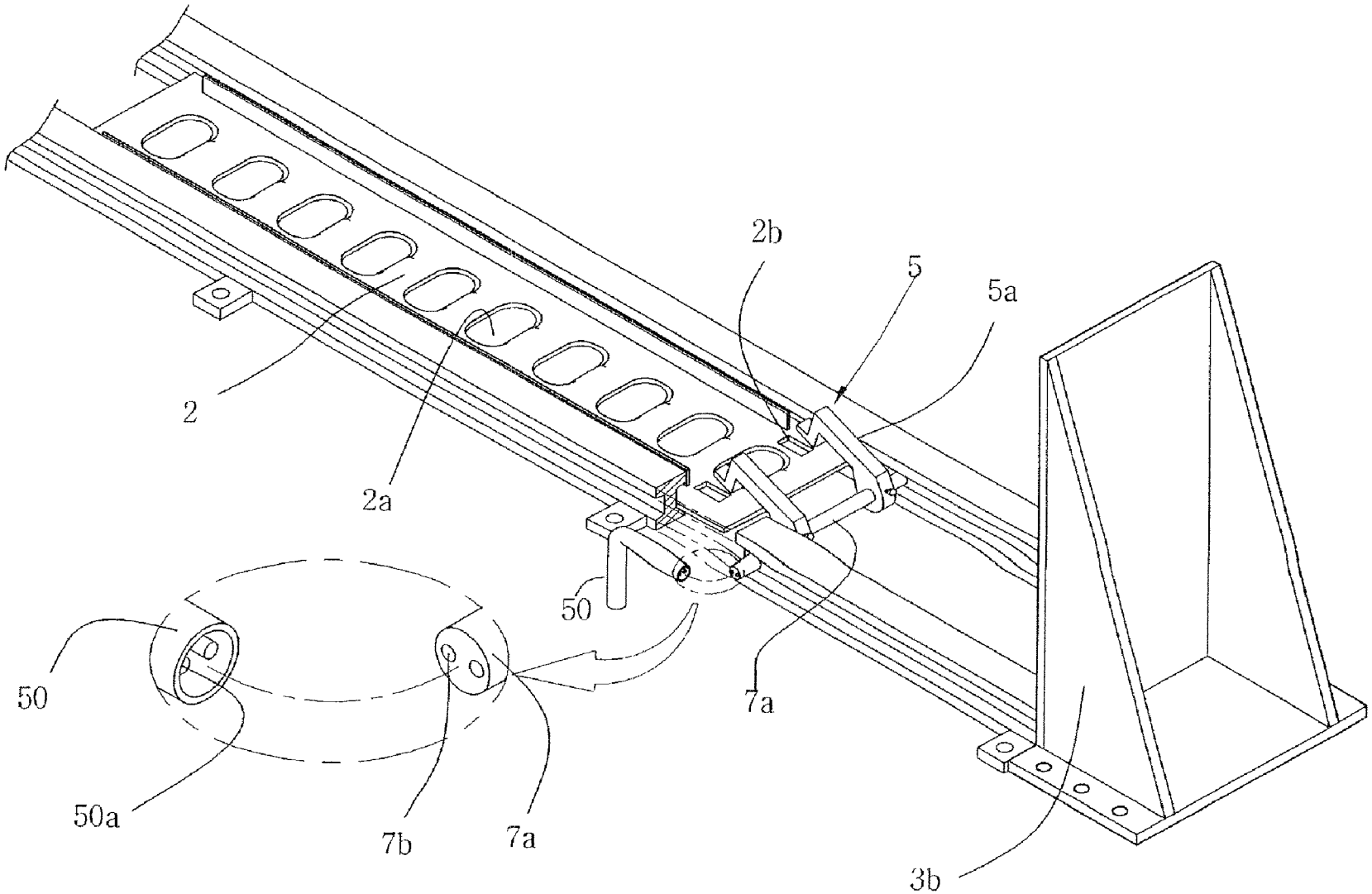
FIG. 5 is a perspective view showing the coupling of a tool for manipulating a ladder holding device.
Figure 6:
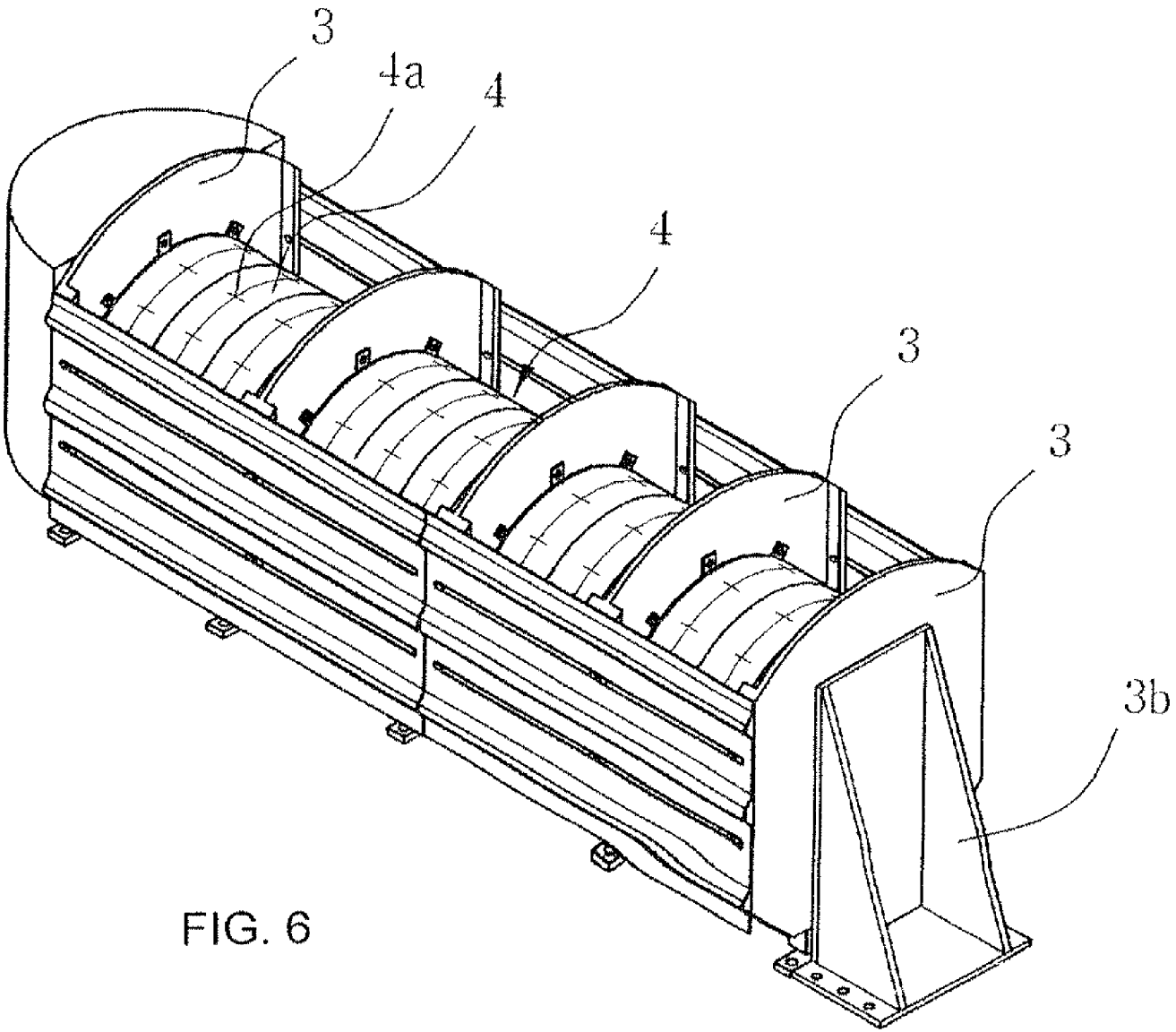
FIG. 6 is a perspective view showing the initial installation of the conventional impact absorbing apparatus of FIG. 3.
Figure 7:
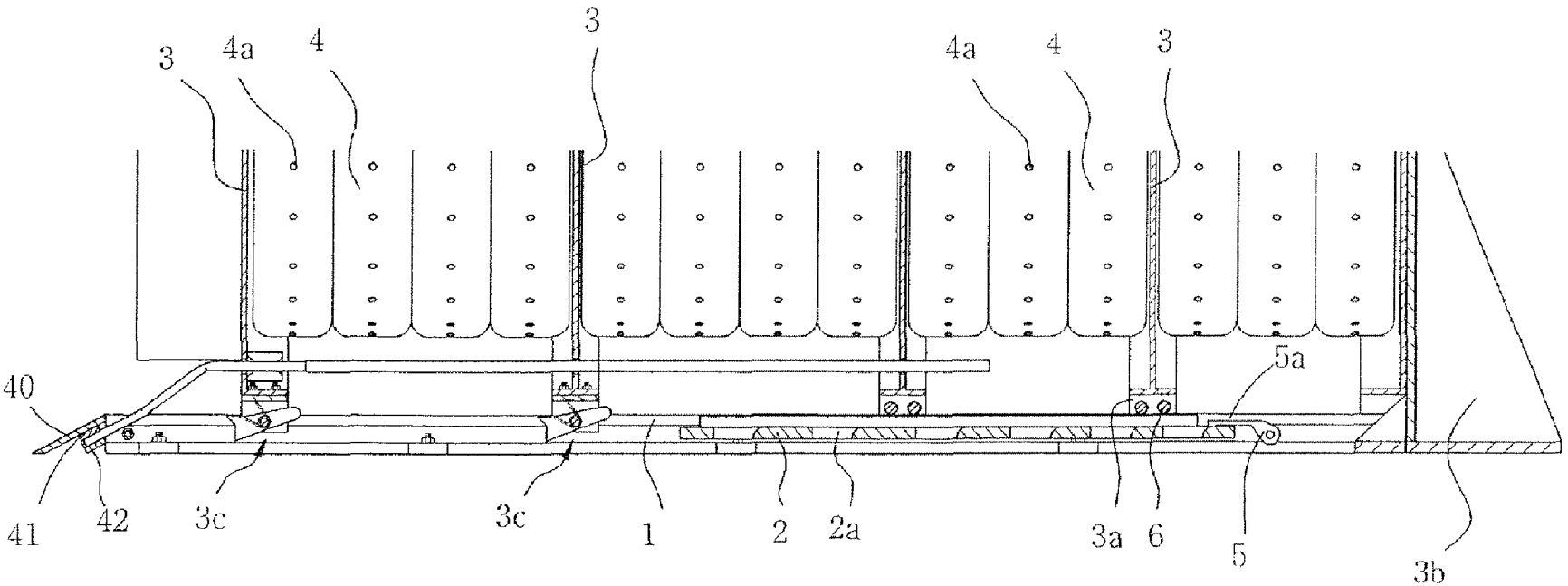
FIG. 7 is a sectional view showing the state of the impact absorbing apparatus of FIG. 6 when no vehicle collides therewith.
Figure 8:
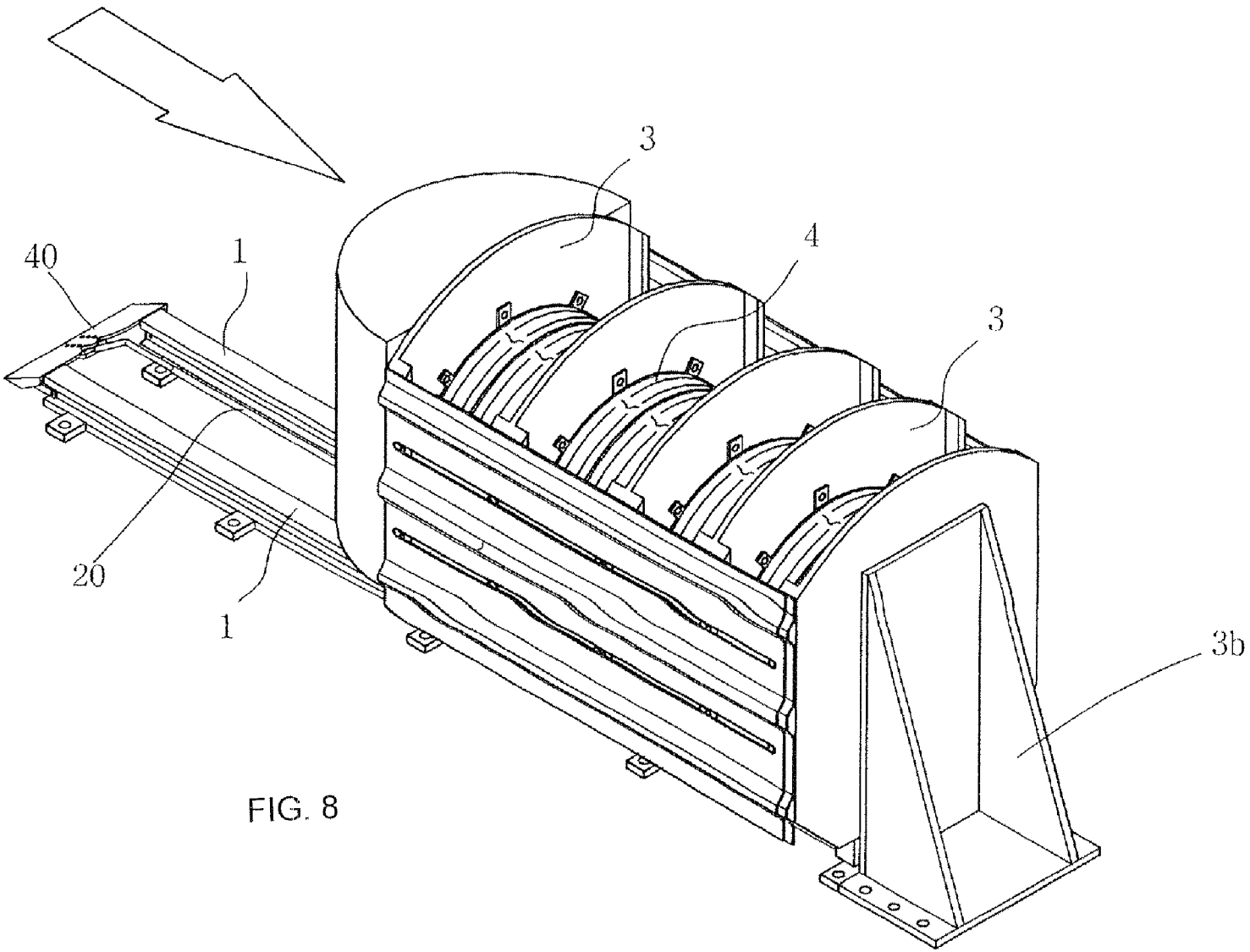
FIG. 8 is a perspective view showing a state of the impact absorbing apparatus after a vehicle collides therewith.
Figure 9:
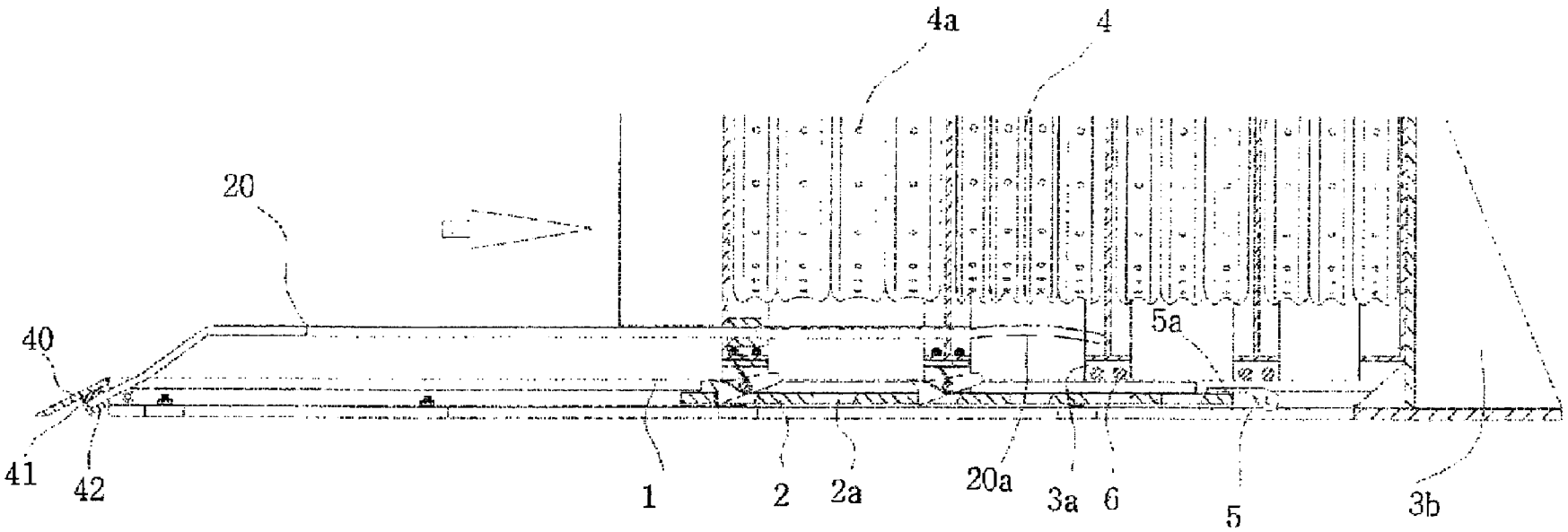
FIG. 9 is a sectional view showing the state of the impact absorbing apparatus of FIG. 8 after the vehicle collides therewith.
Figure 10:
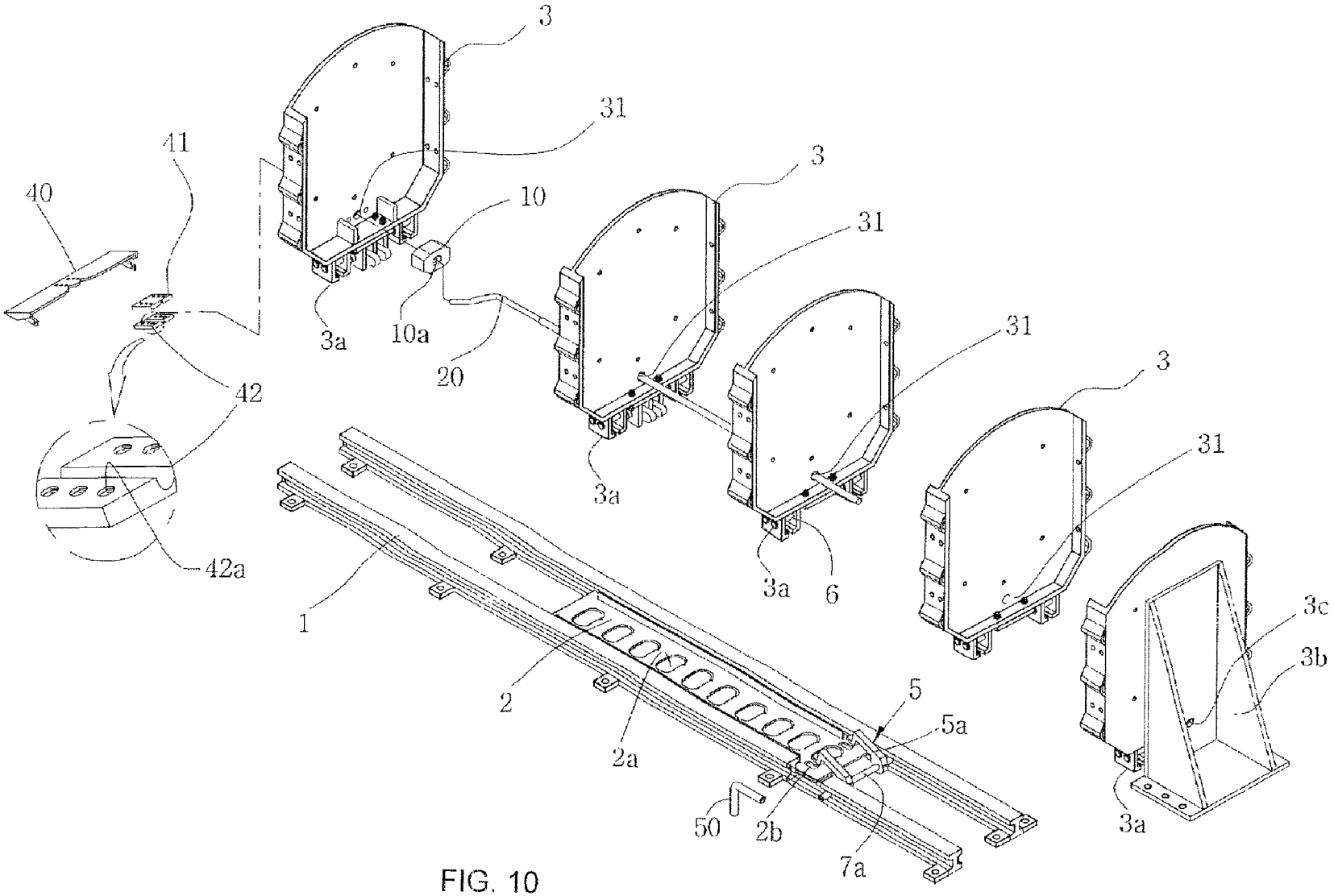
FIG. 10 is an exploded perspective view illustrating critical parts of an apparatus for absorbing the impact of a vehicle collision, according to a first embodiment of the present invention.
Figure 11:
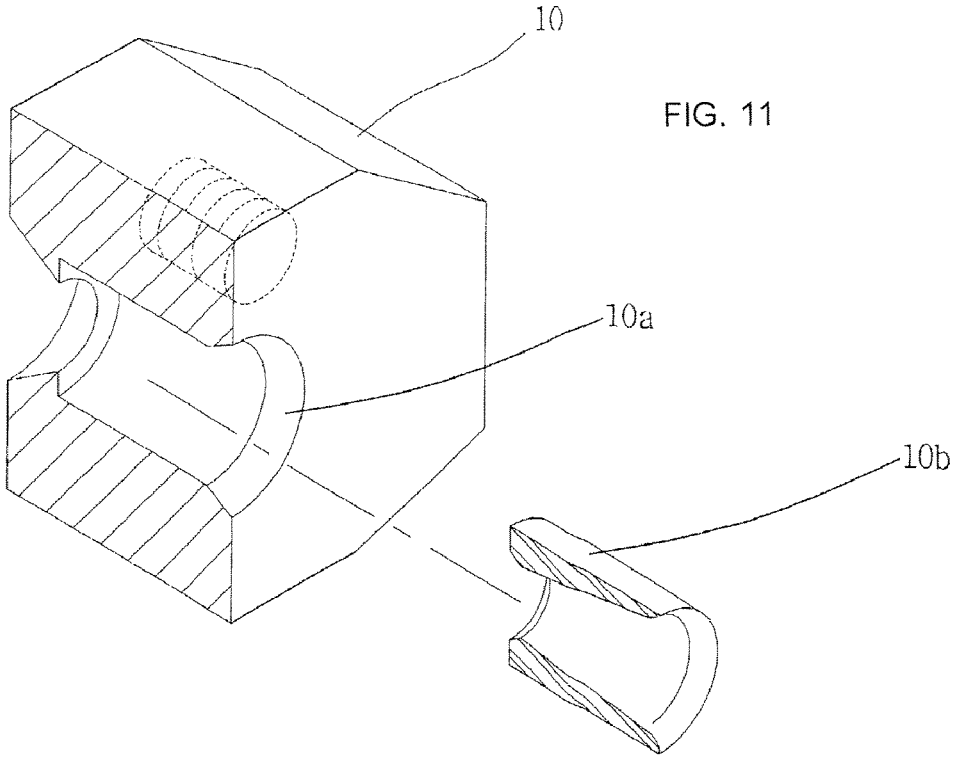
FIG. 11 is a partially broken enlarged view of a partition moving speed control member shown in FIG. 10.
Figure 12:
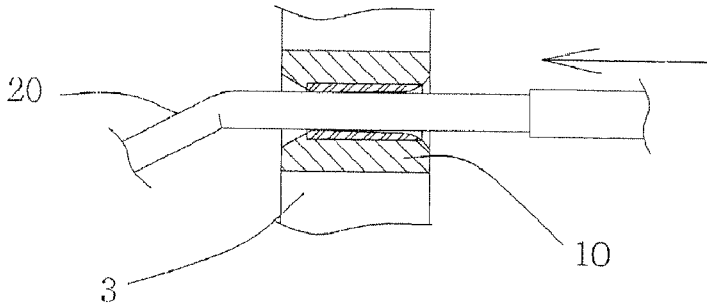
FIGS. 12 through 15 are sectional views showing the movement of a partition moving speed control member used in the present invention.
Figure 13:
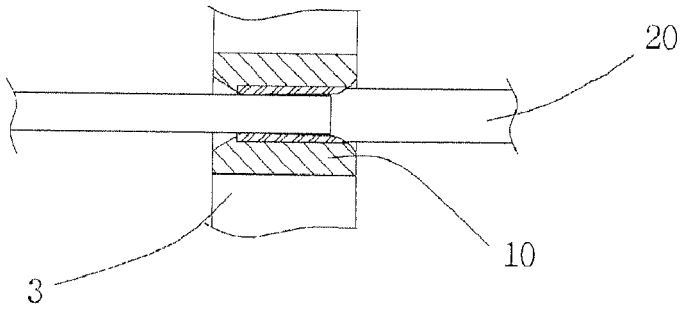
Figure 14:
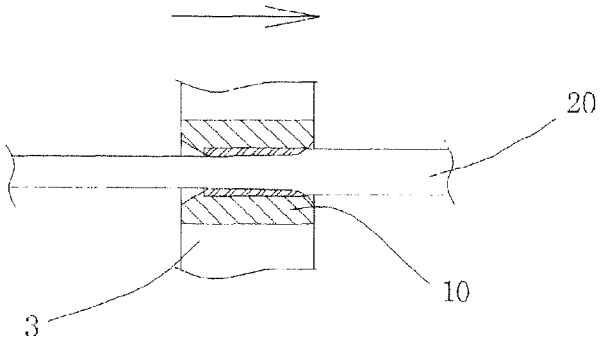
Figure 15:
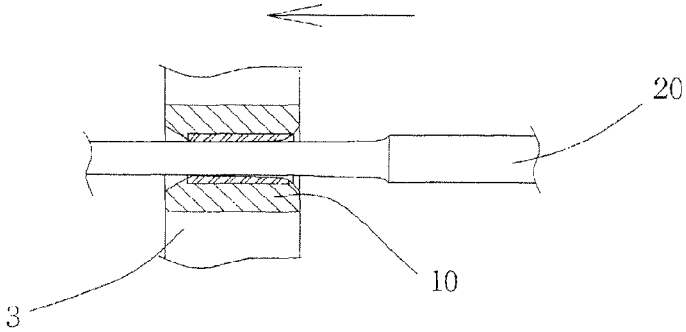
Figure 16:
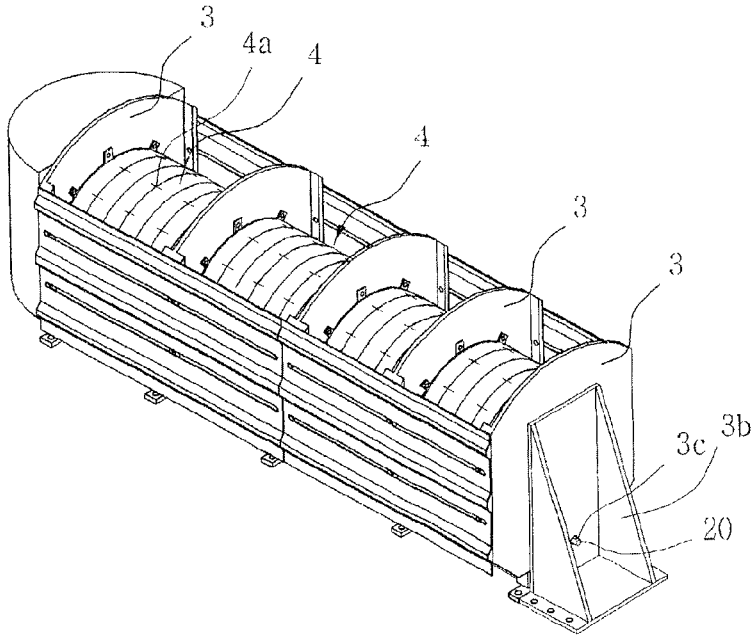
FIG. 16 is a perspective view showing the initial installation of the impact absorbing apparatus according to the first embodiment of the present invention.
Figure 17:
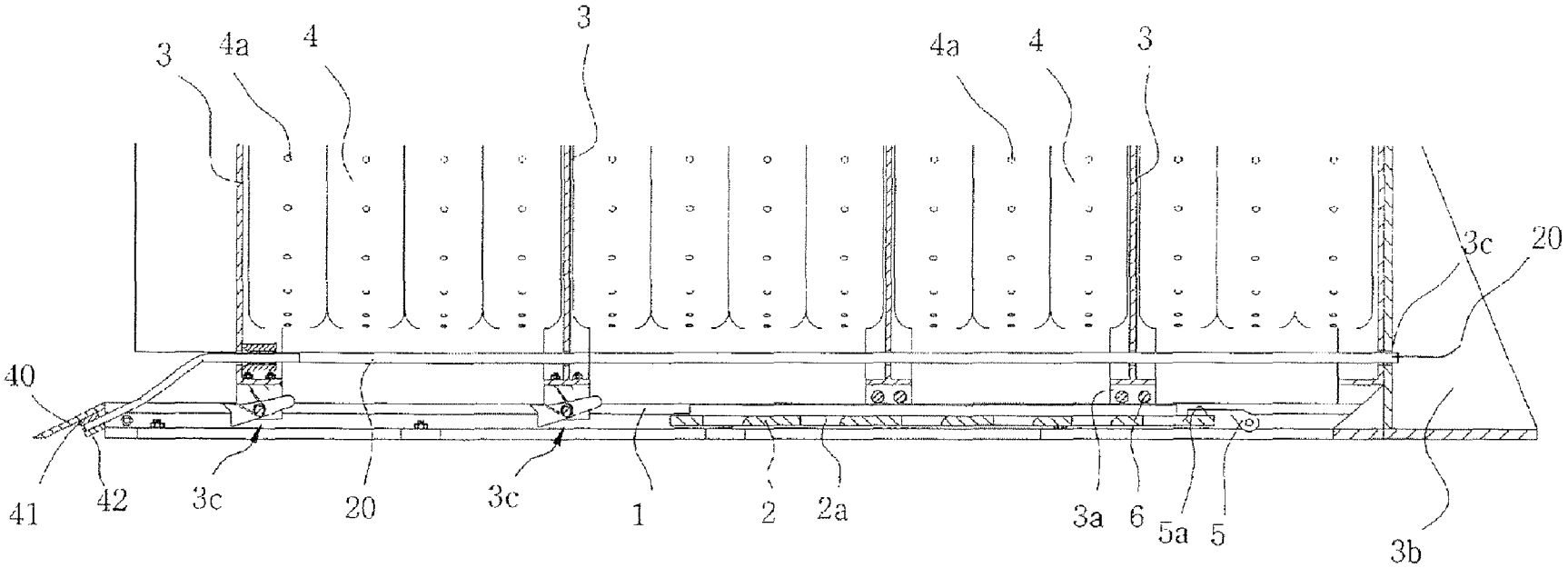
FIG. 17 is a sectional view showing the state of the impact absorbing apparatus of FIG. 16 when no vehicle collides therewith.
Figure 18:
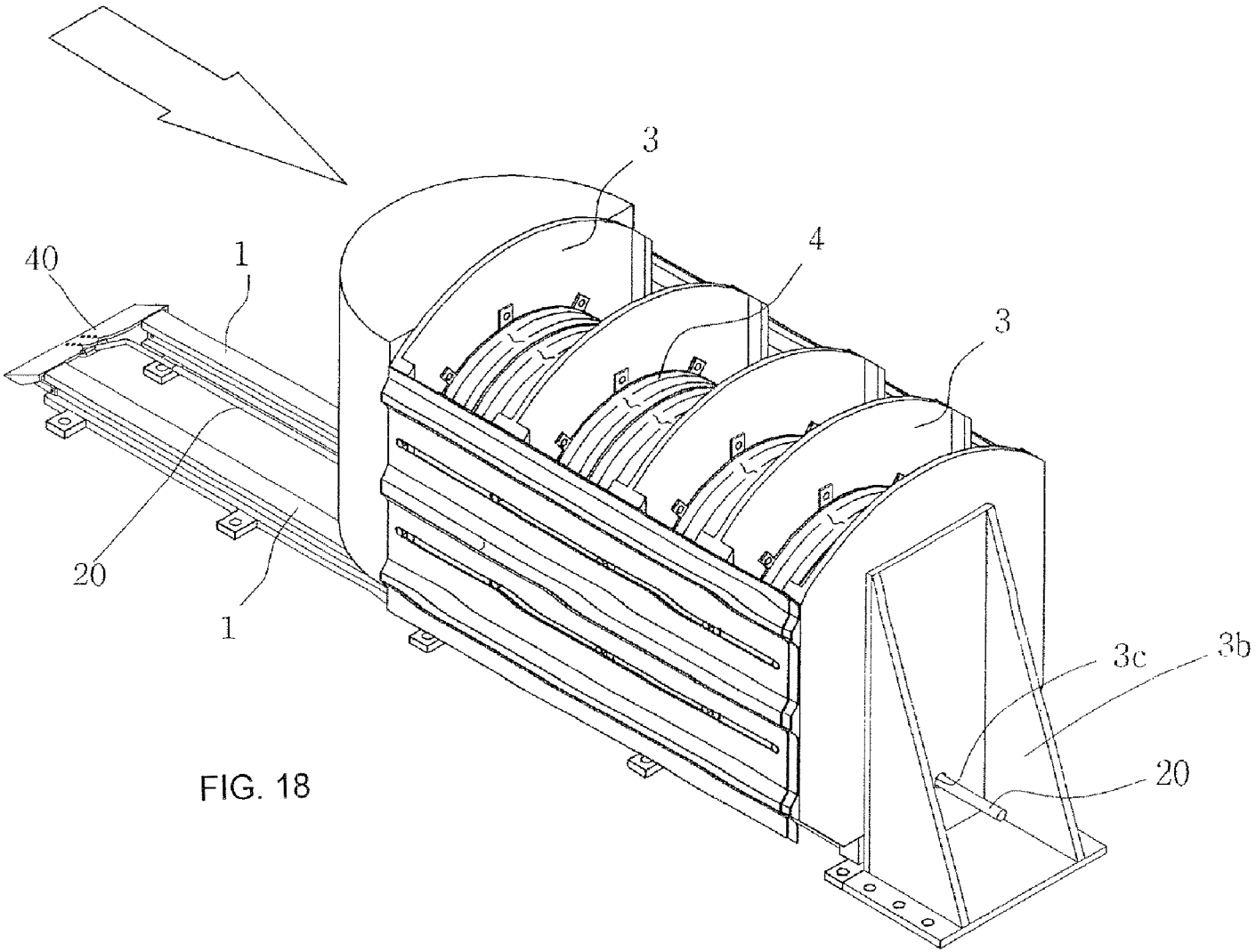
FIG. 18 is a perspective view showing the state of the impact absorbing apparatus of the first embodiment of the present invention after a vehicle collides therewith.
Figure 19:
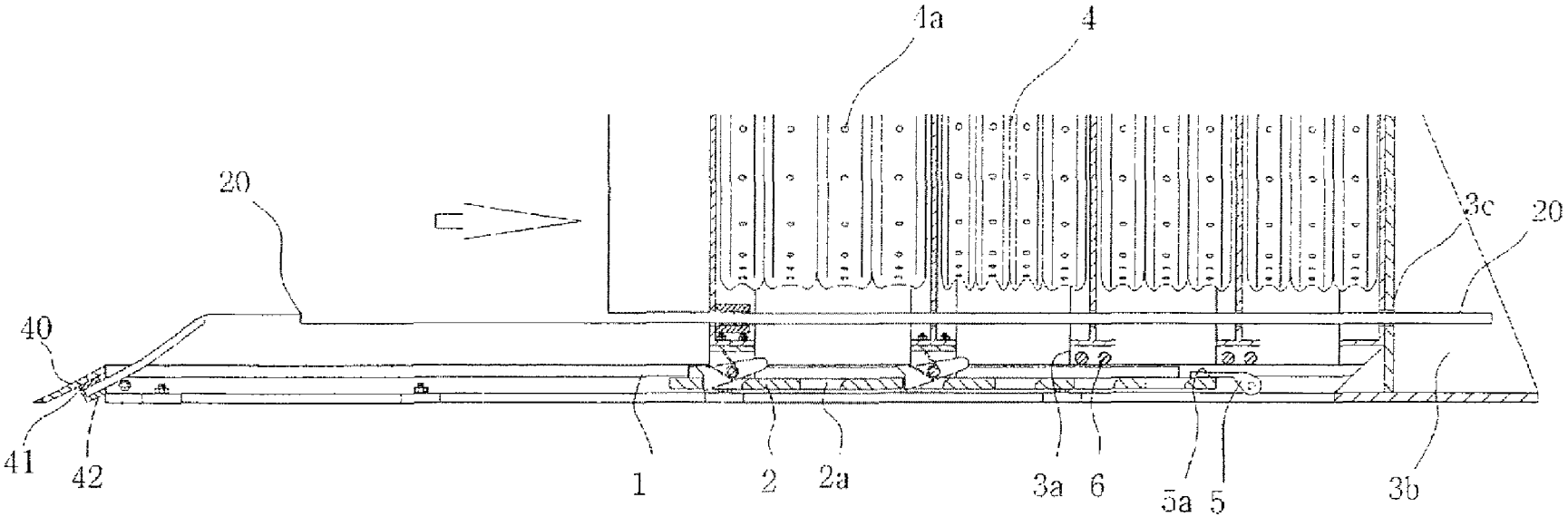
FIG. 19 is a sectional view showing the state of the impact absorbing apparatus of FIG. 18 after the vehicle collides therewith.
Figure 20:
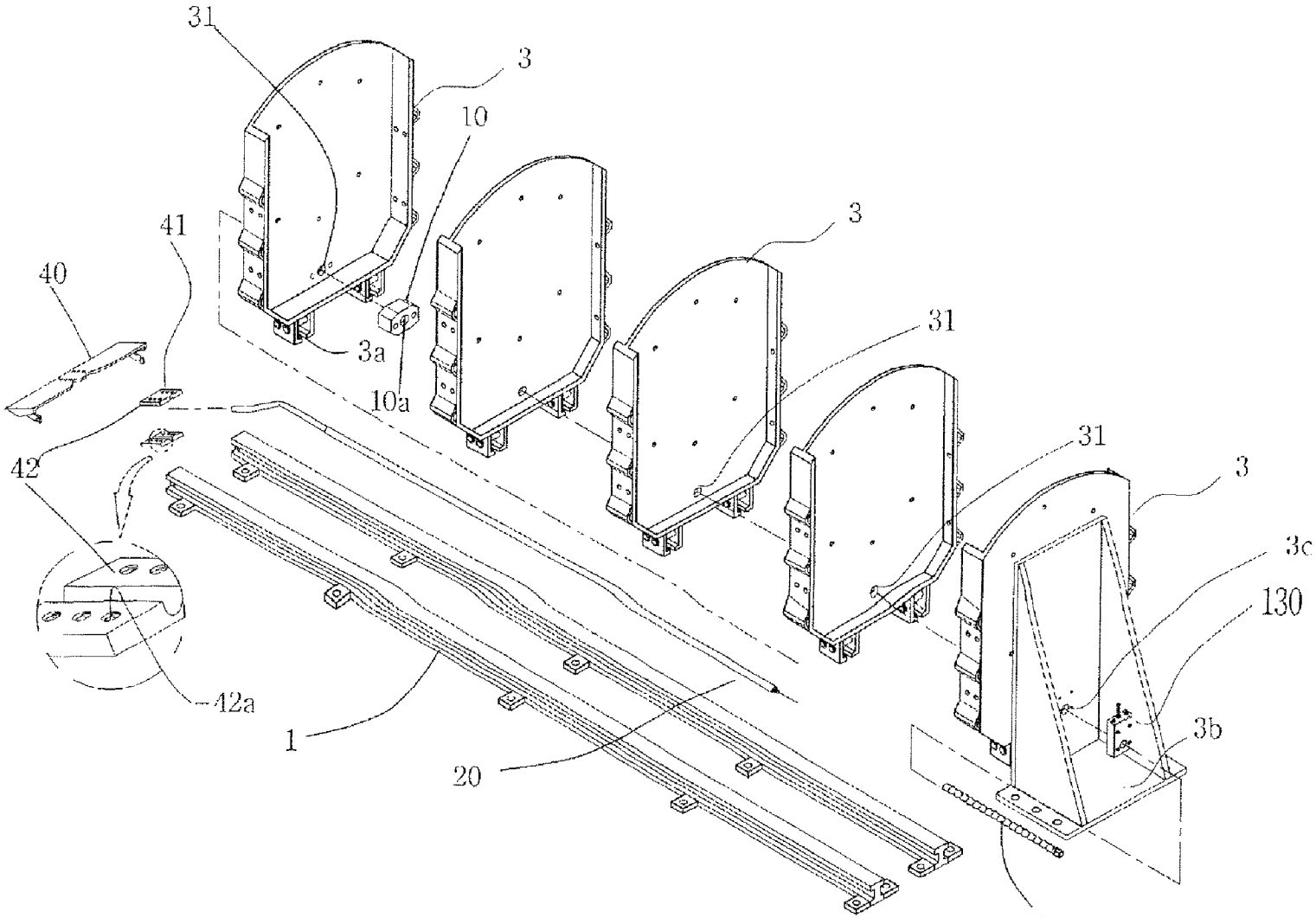
FIG. 20 is an exploded perspective view of an apparatus for absorbing the impact of a vehicle collision, according to a second embodiment of the present invention.
Figure 21:
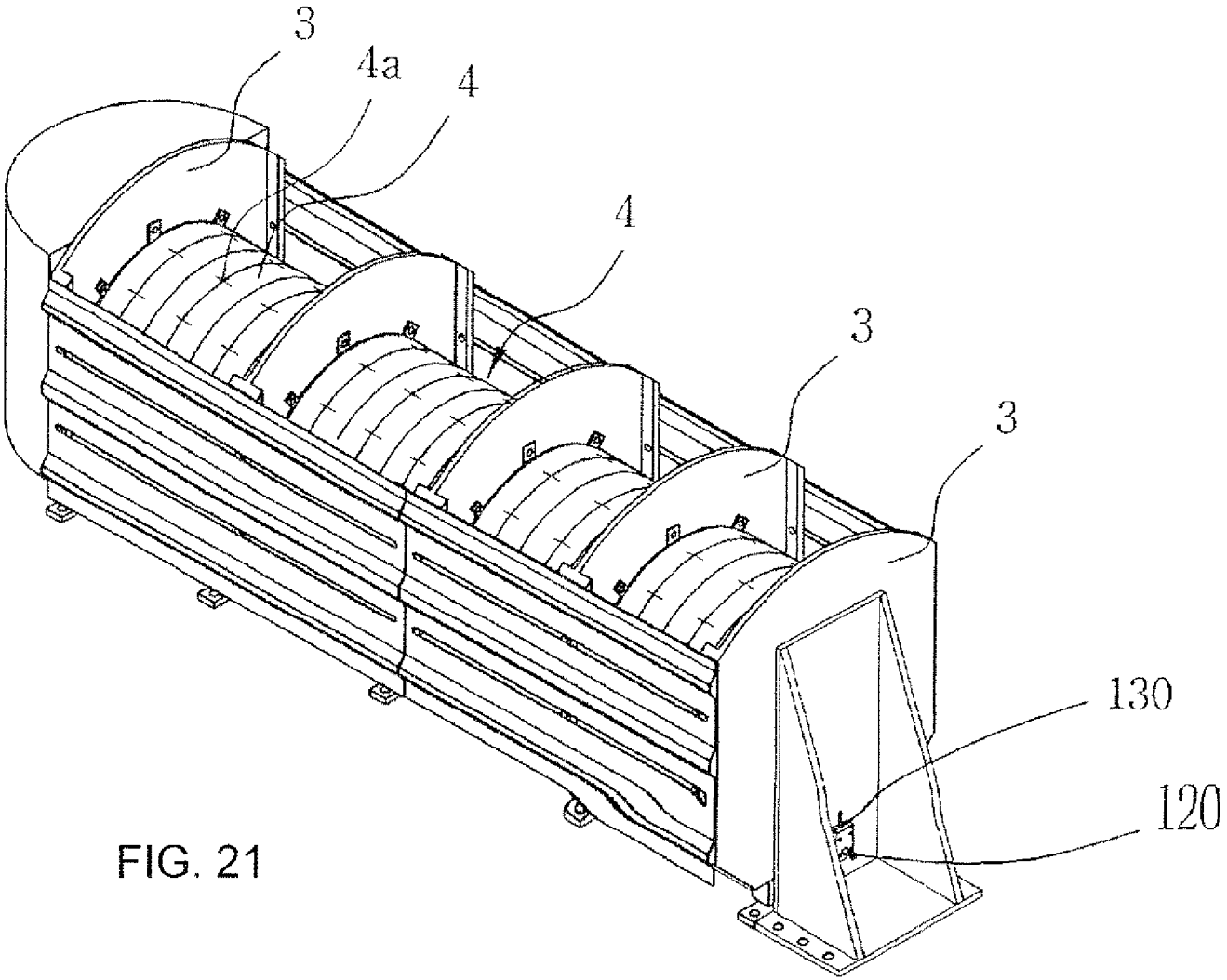
FIG. 21 is a perspective view showing the initial installation of the impact absorbing apparatus of FIG. 20.
Figure 22:
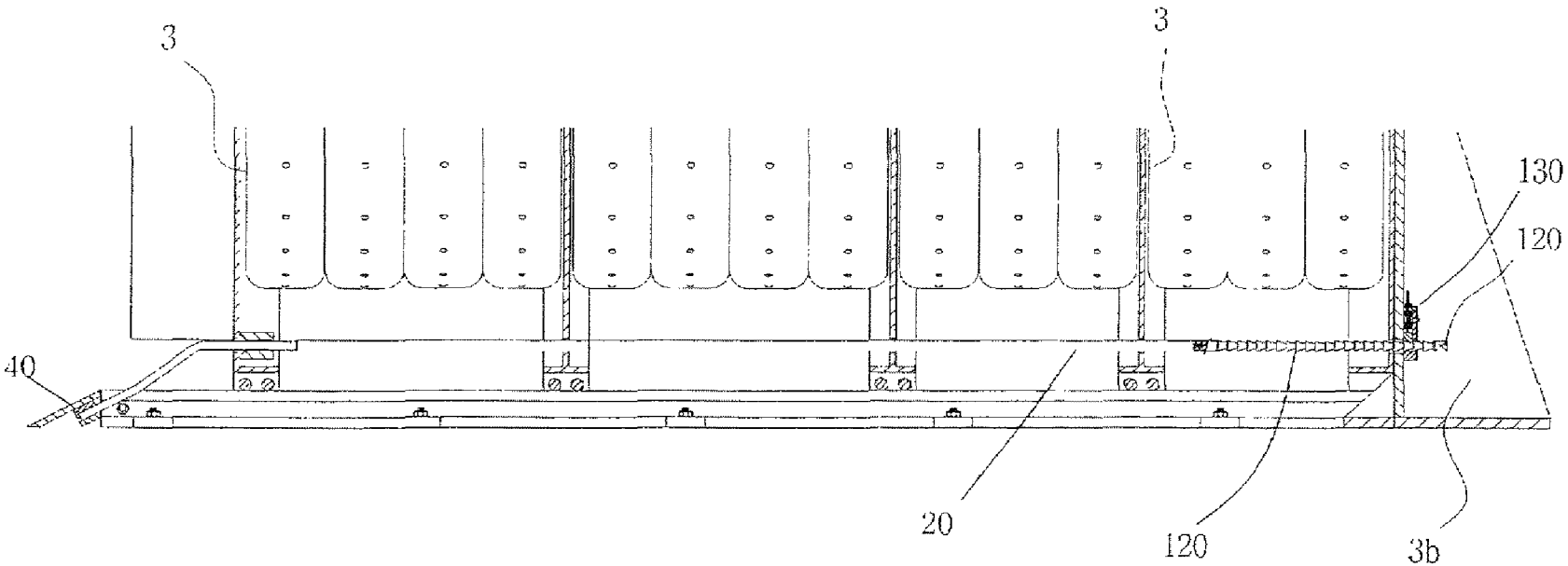
FIG. 22 is a sectional view showing the state of the impact absorbing apparatus of FIG. 21 when no vehicle collides therewith.
Figure 23:
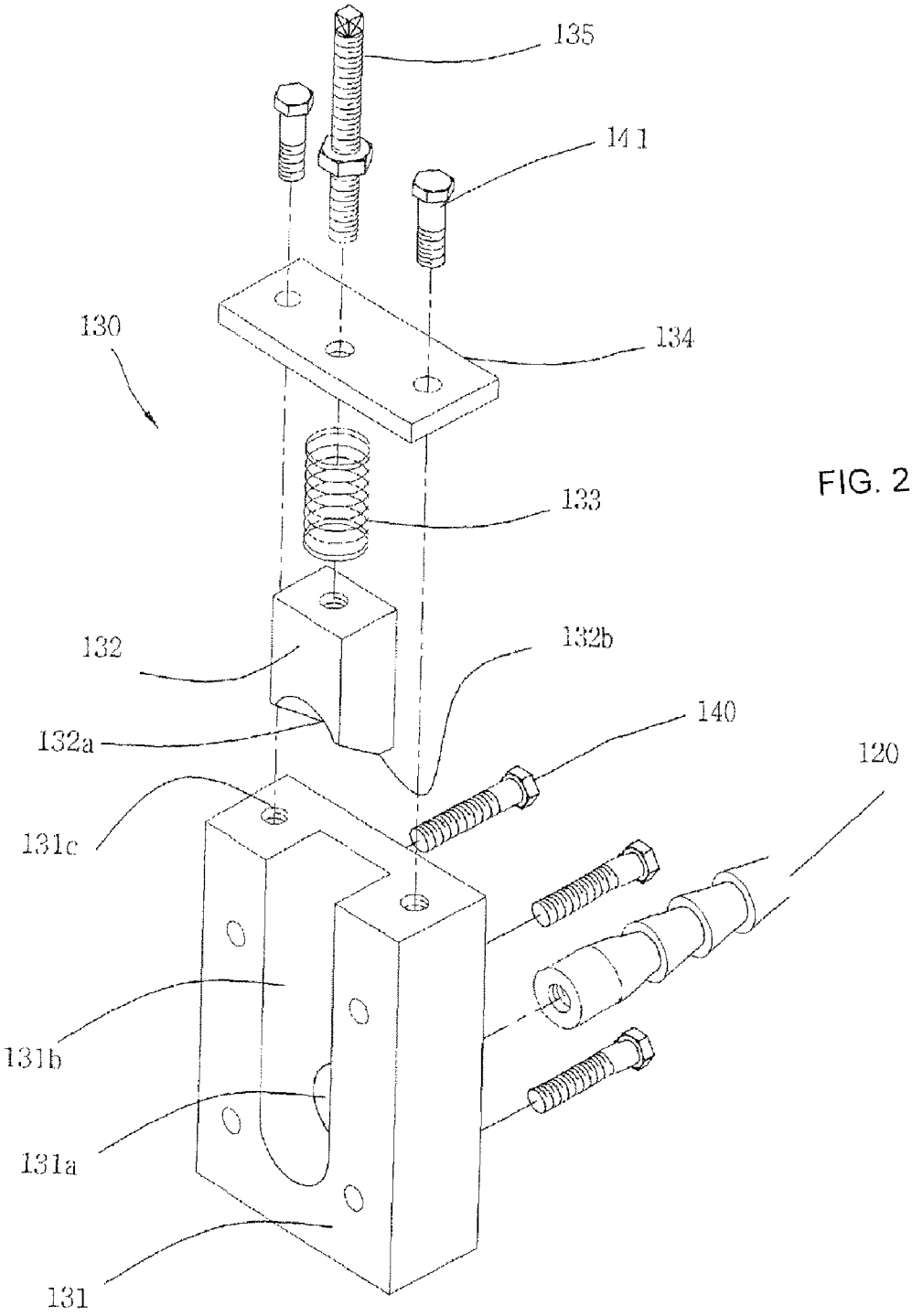
FIG. 23 is an exploded perspective view of a locker shown in FIG. 20.
Figure 24:
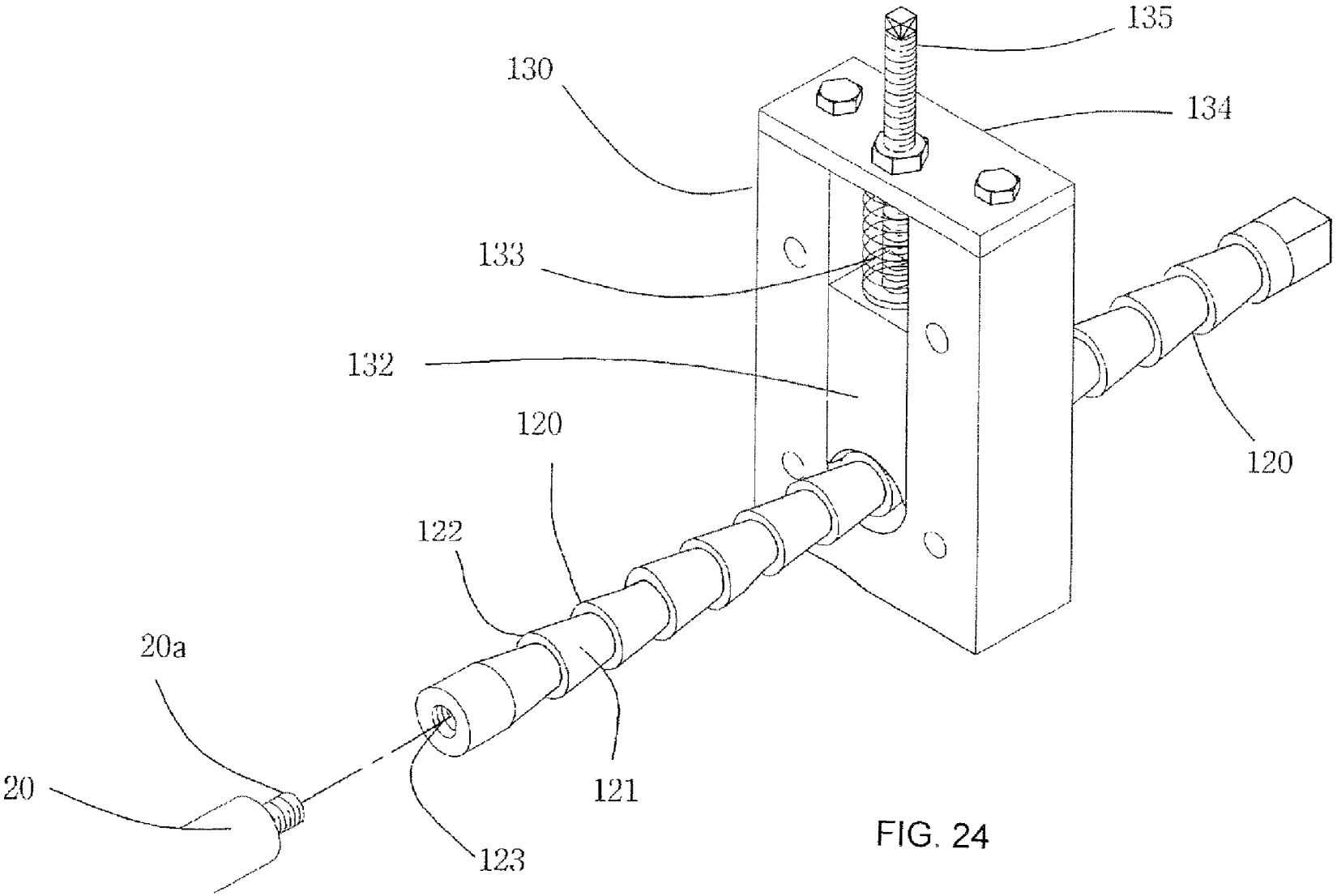
FIG. 24 is a perspective view showing the insertion of a locking rod into the locker.
Figure 25:
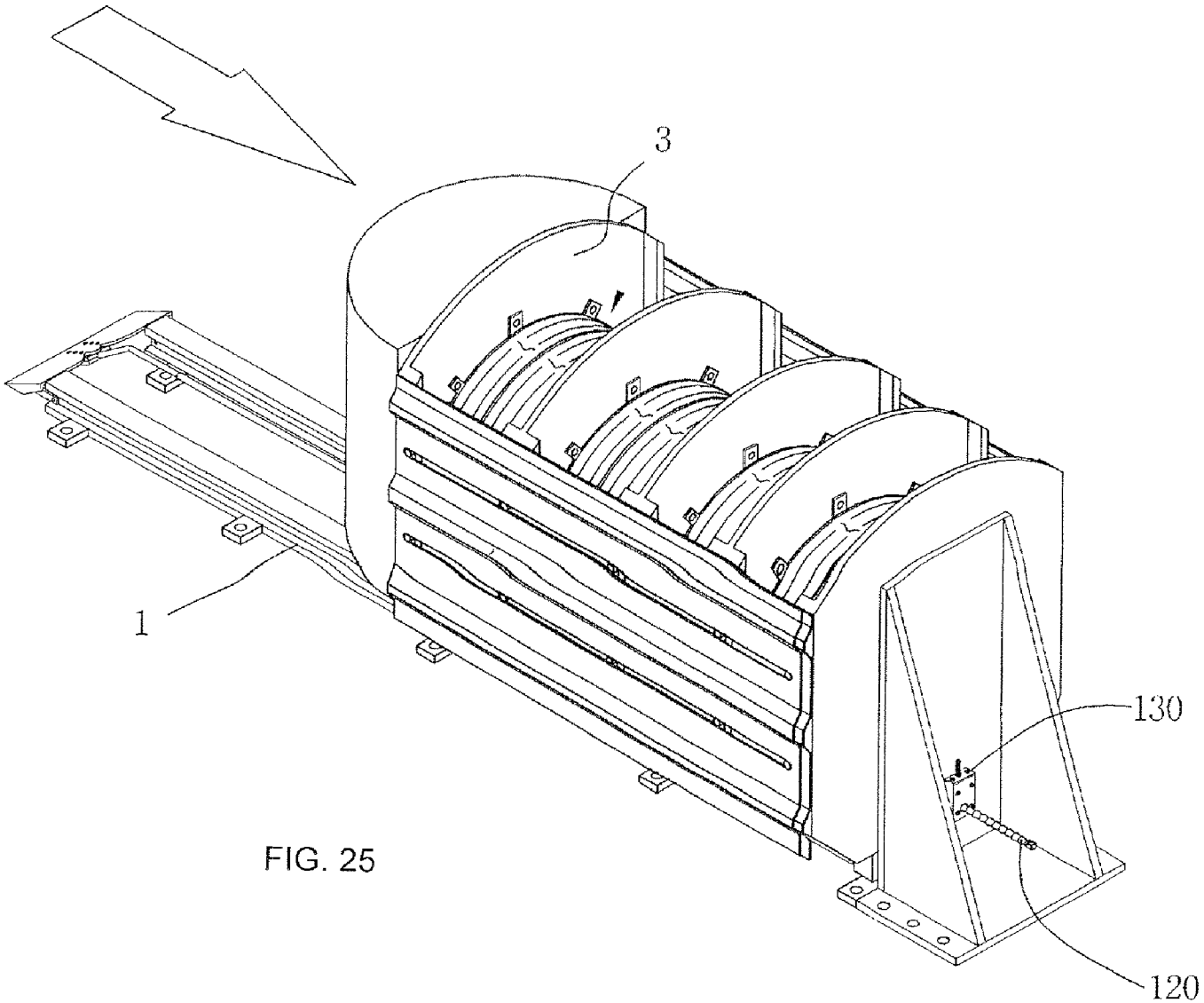
FIGS. 25 and 26 are, respectively, a perspective view and a sectional view showing the state of the impact absorbing apparatus of the second embodiment of the present invention after a vehicle collides therewith.
Figure 26:
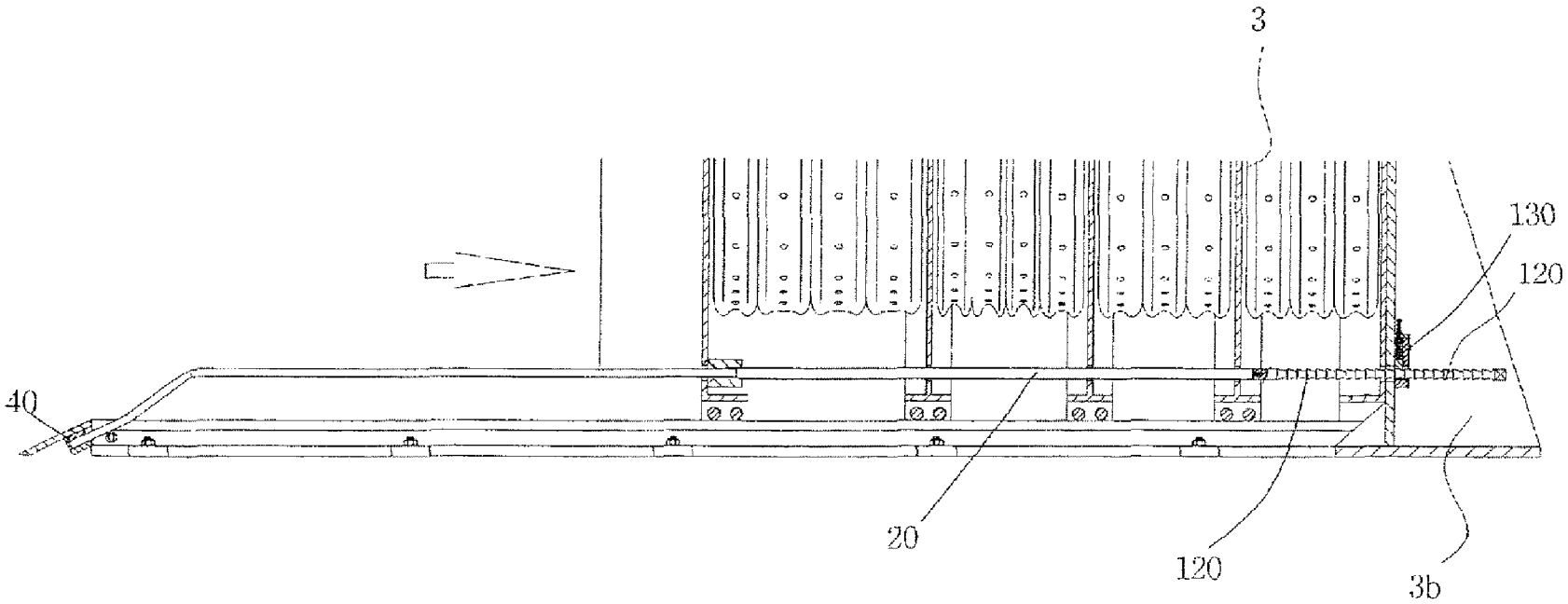
Figure 27:
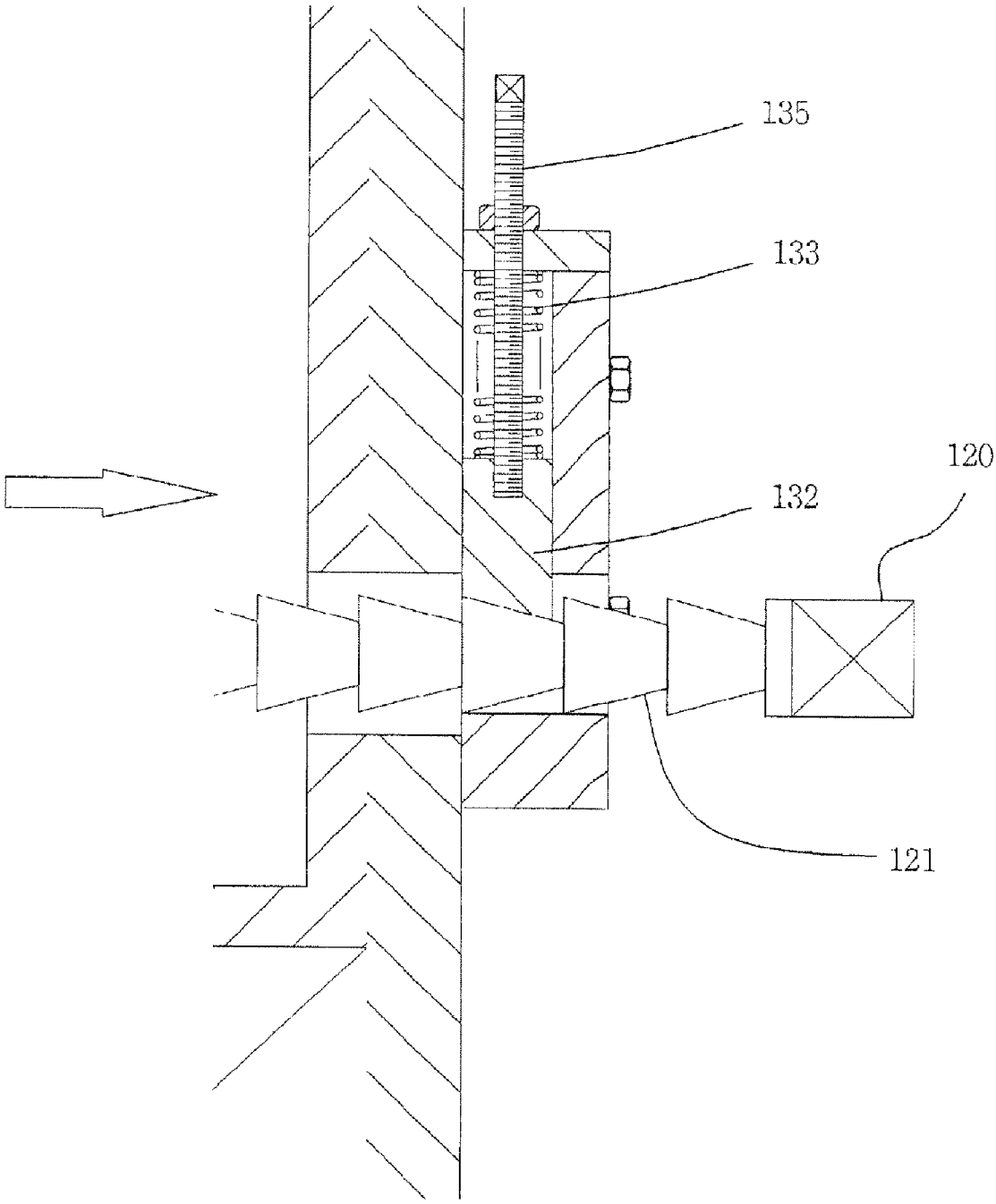
FIGS. 27 through 29 are sectional views showing the operation of the locker and the locking rod when the vehicle collides with the impact absorbing apparatus.
Figure 28:
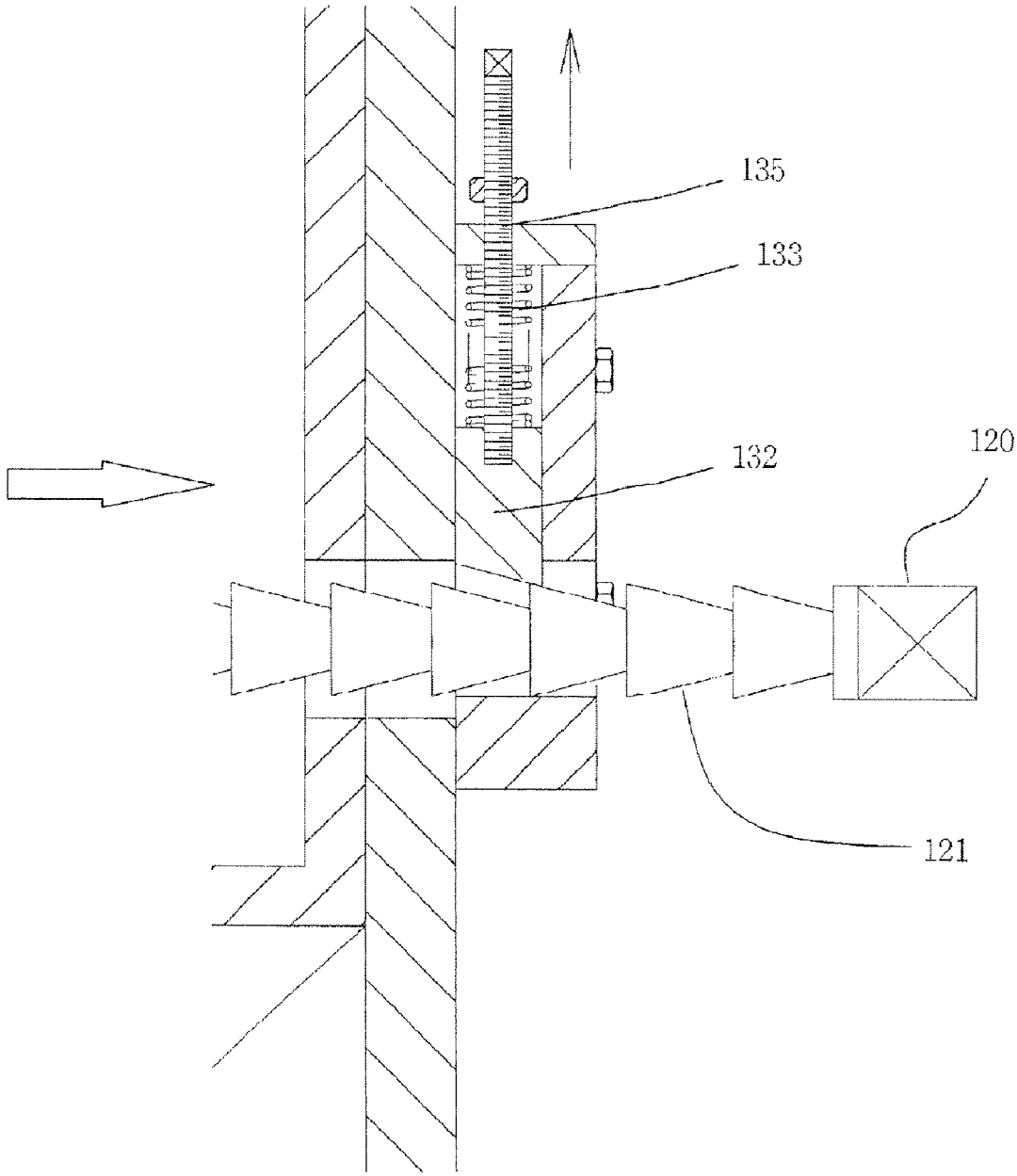
Figure 29:
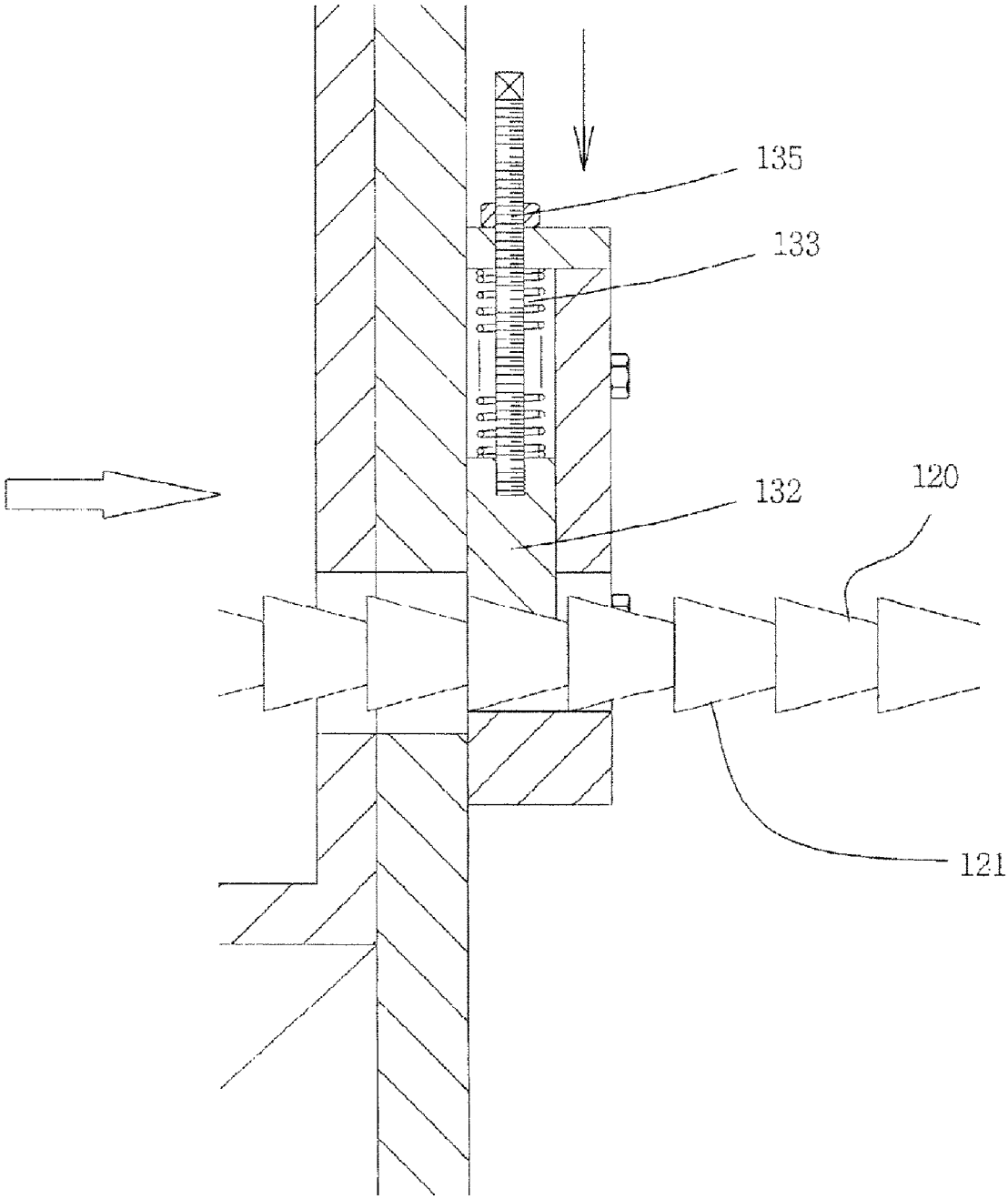
Figure 30:
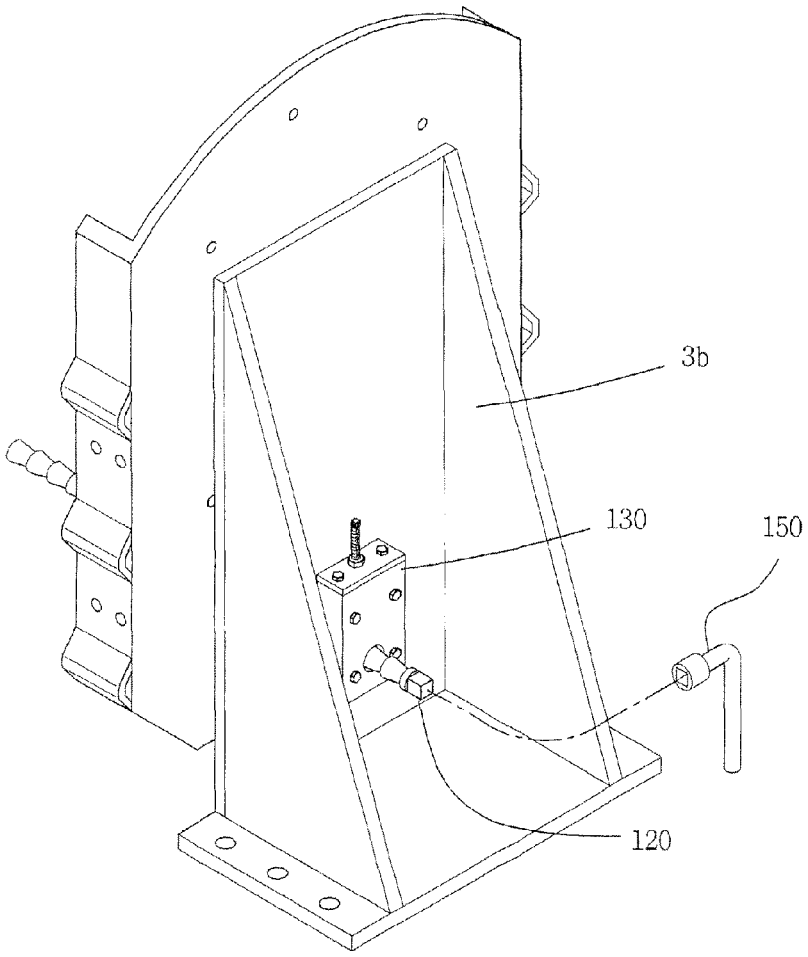
FIG. 30 is a perspective view illustrating a method of releasing the locking rod according to the second embodiment of the present invention.
Figure 31:
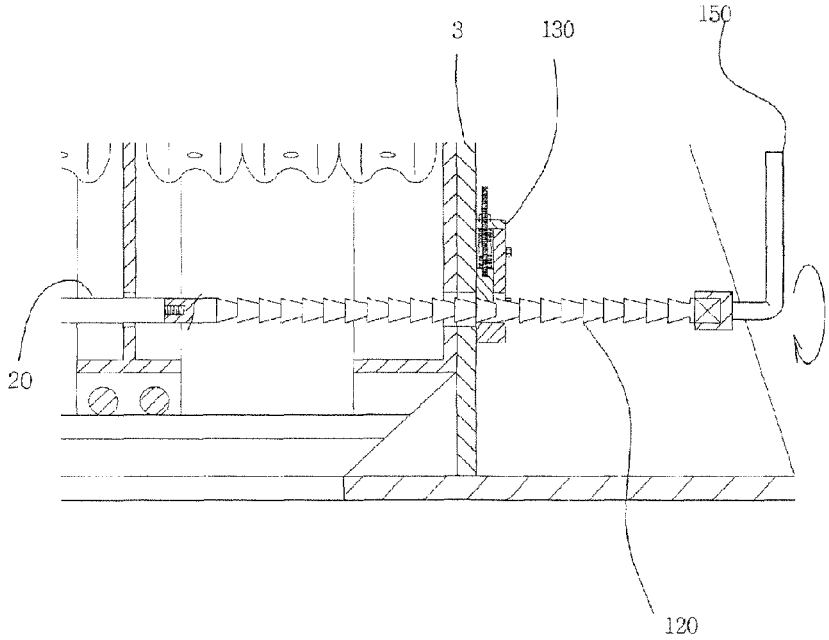
FIGS. 31 and 32 are sectional views illustrating the method of removing the locking rod.
Figure 32:
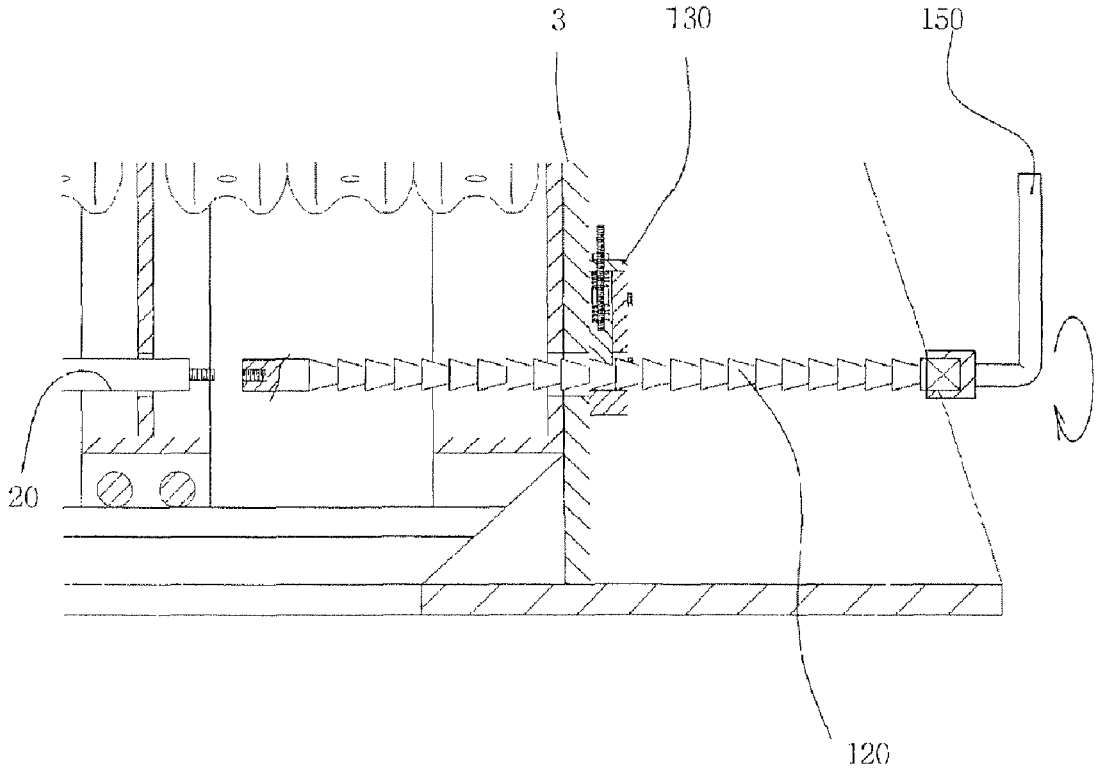
Figure 33:
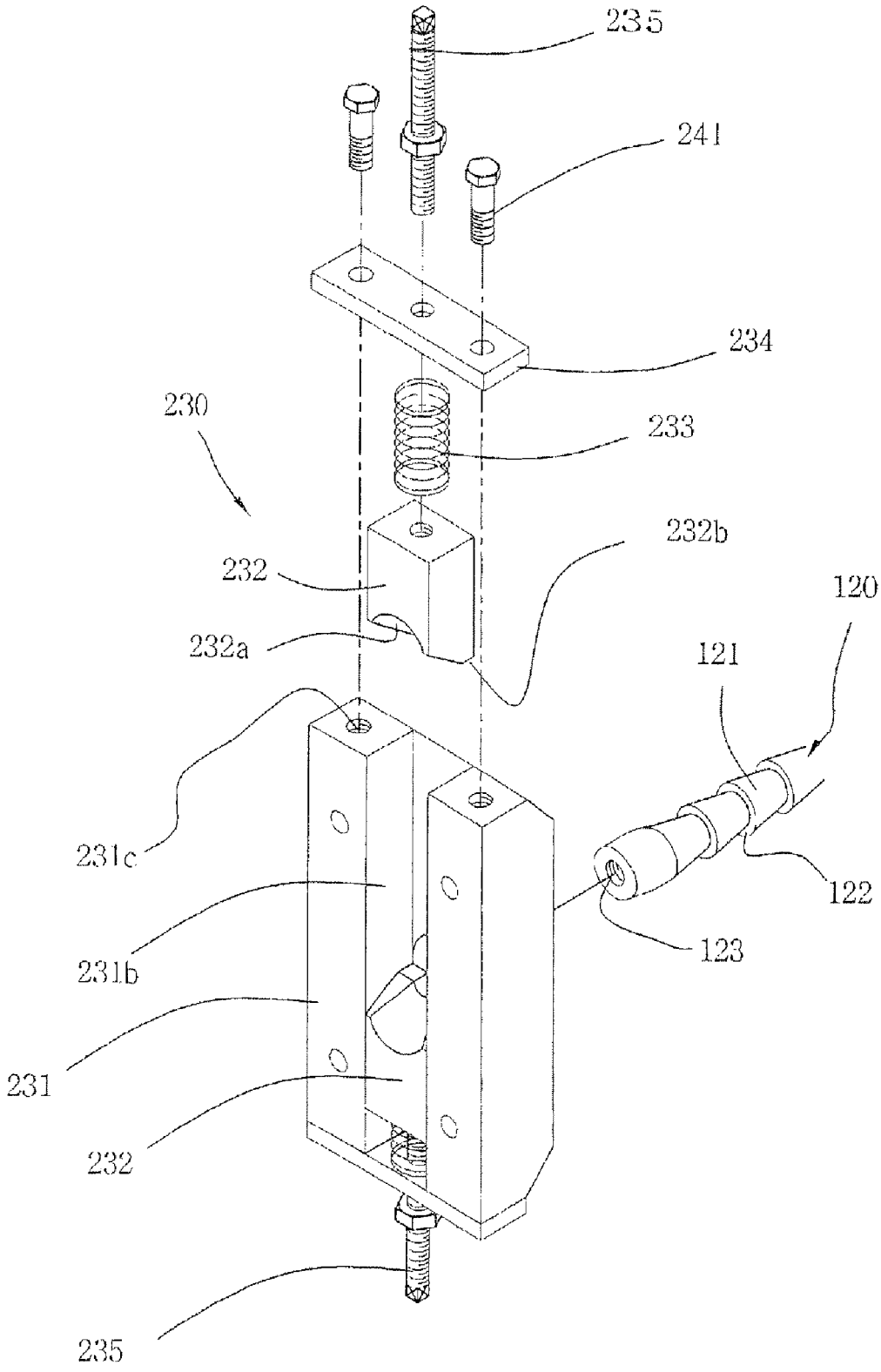
FIG. 33 is an exploded perspective view of a locker, according to a modification of the second embodiment of the present invention.
Figure 34:
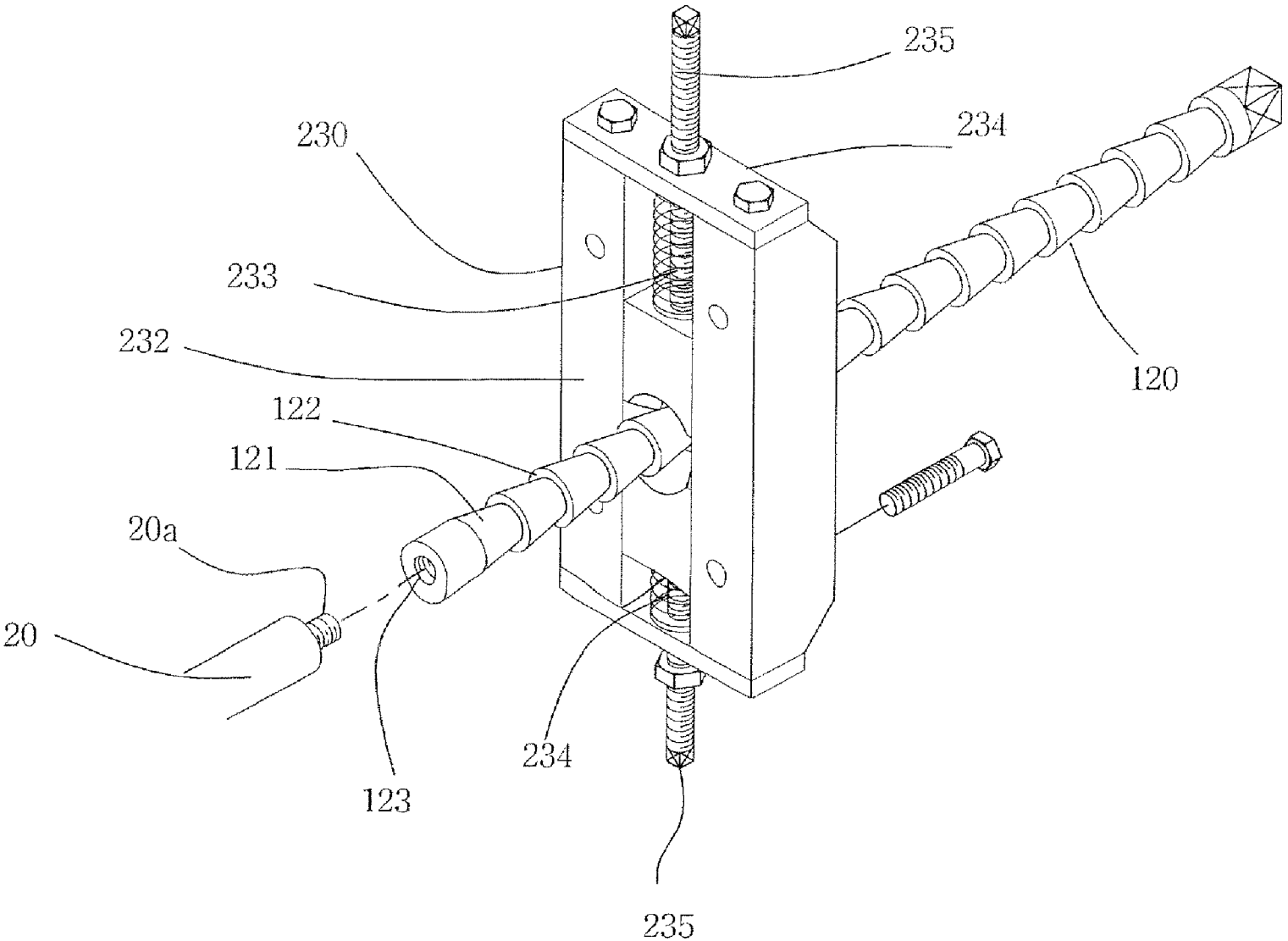
FIG. 34 is a perspective view illustrating the insertion of a locking rod into the locker according to the modification of FIG. 33.
Figure 35:
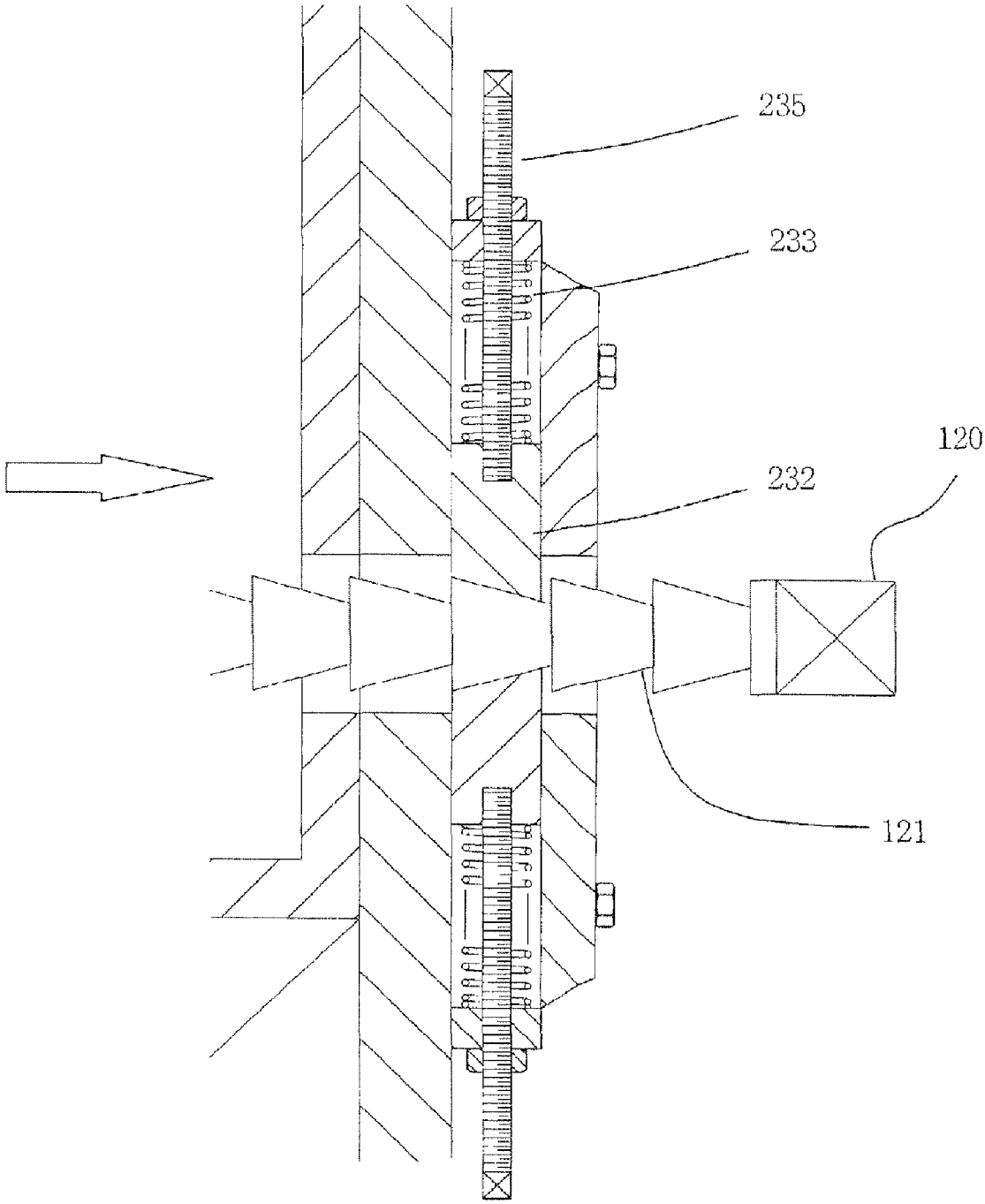
FIGS. 35 through 37 are sectional views illustrating the operation of the locker and the locking rod according to the modification when a vehicle collision occurs.
Figure 36:
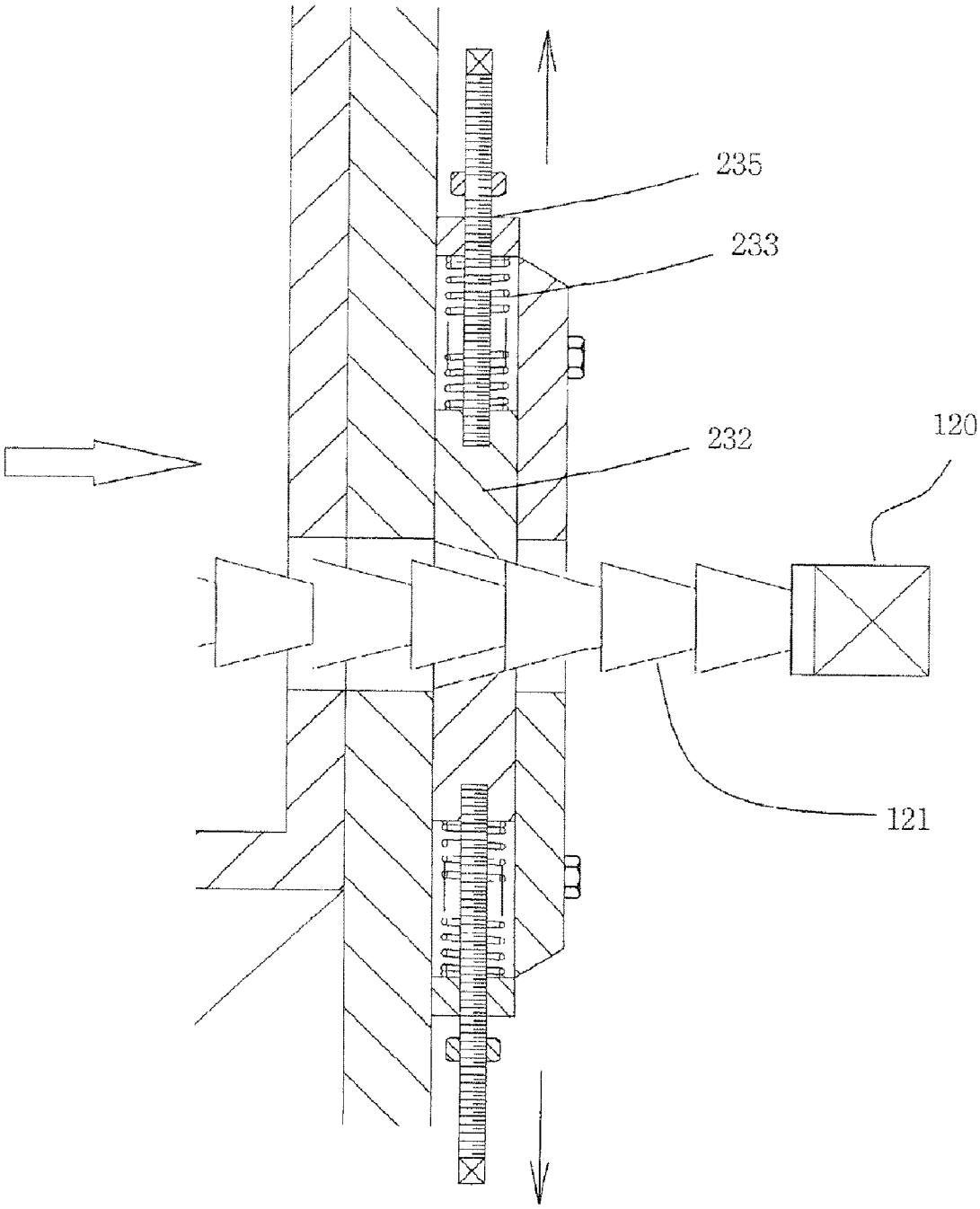
Figure 37:
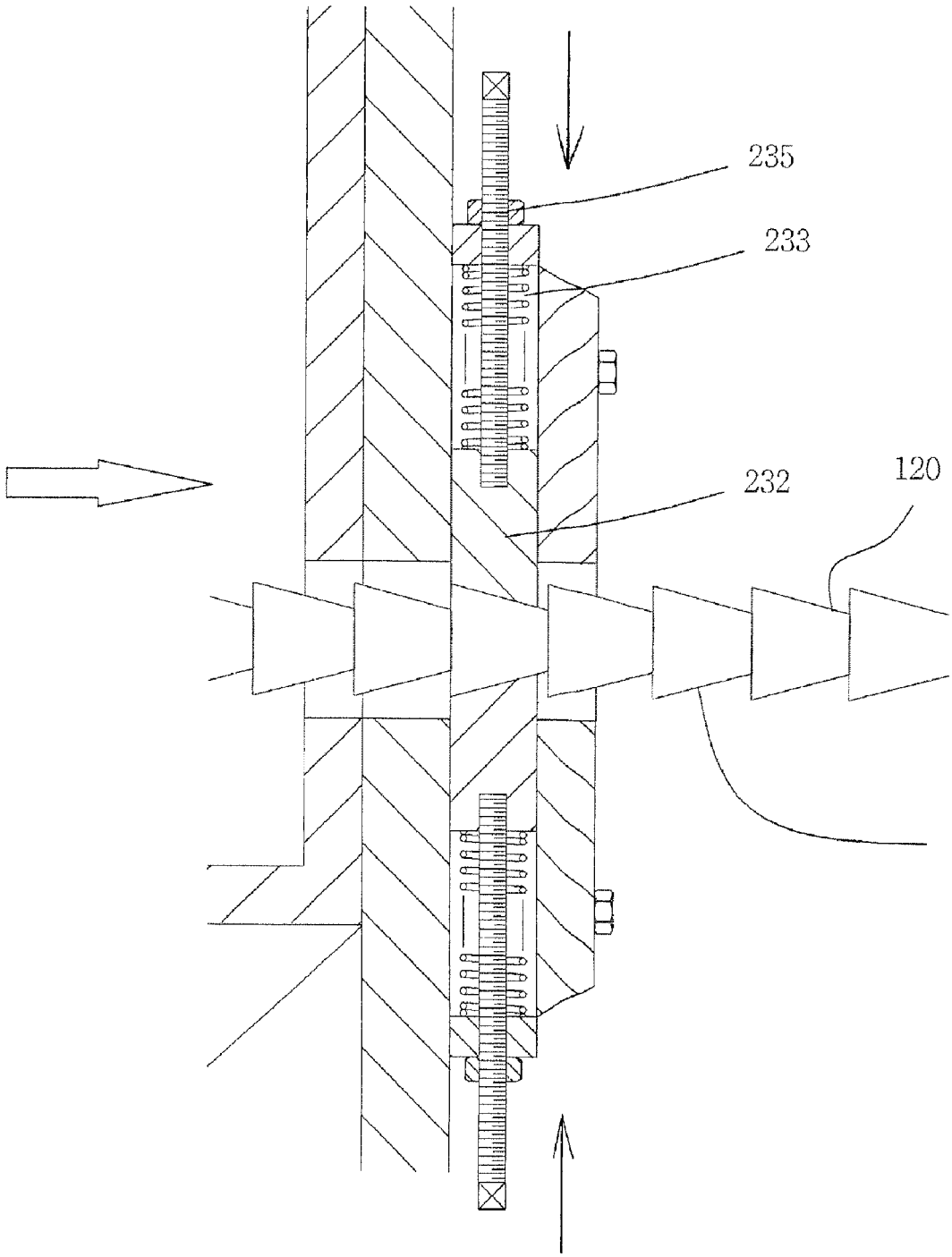
Figure 38:
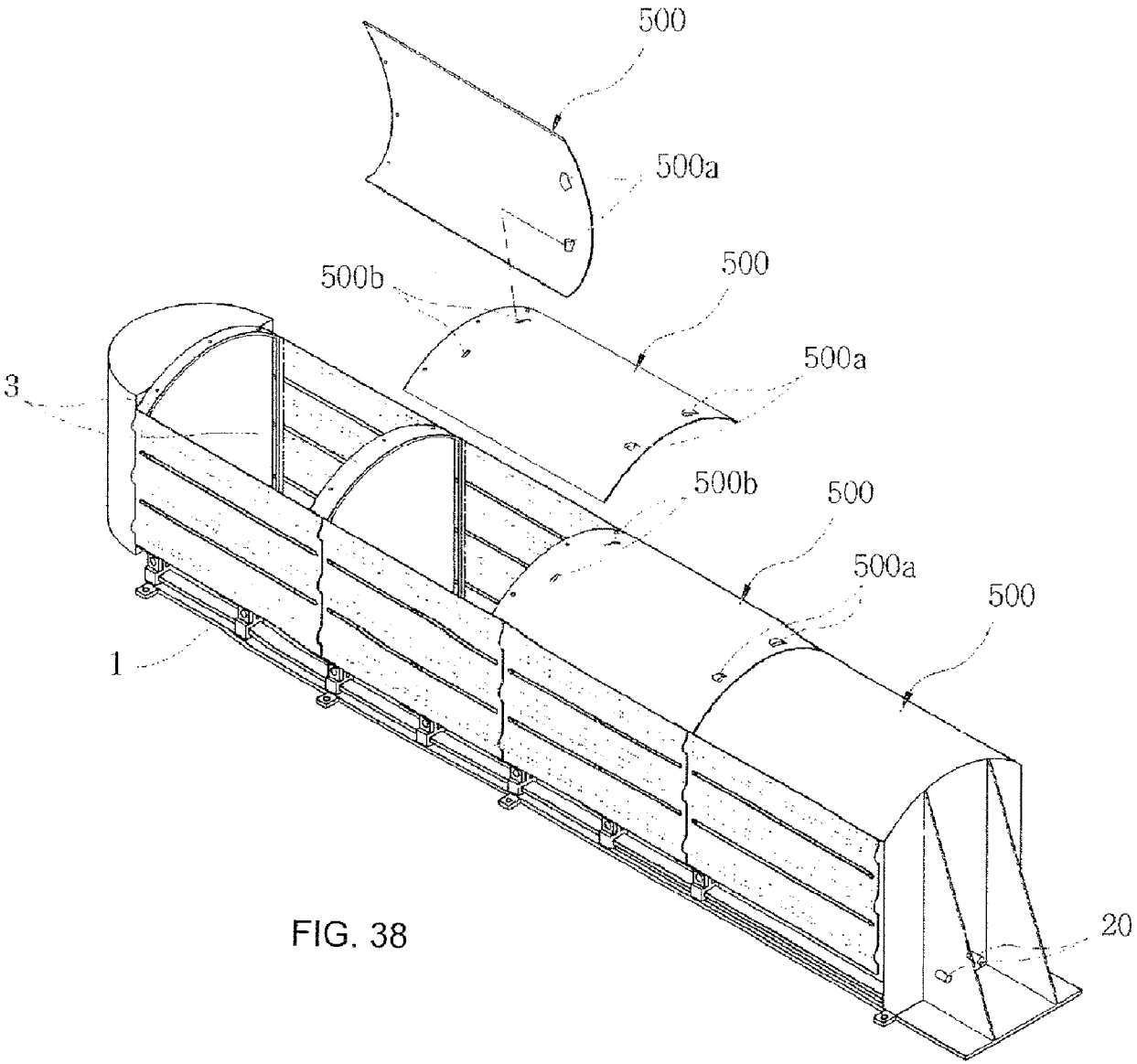
FIG. 38 is a partially exploded perspective view of an apparatus for absorbing the impact of a vehicle collision using a partition moving speed control member and a locking rod, without having scrap tires, according to a third embodiment of the present invention.
Figure 39:
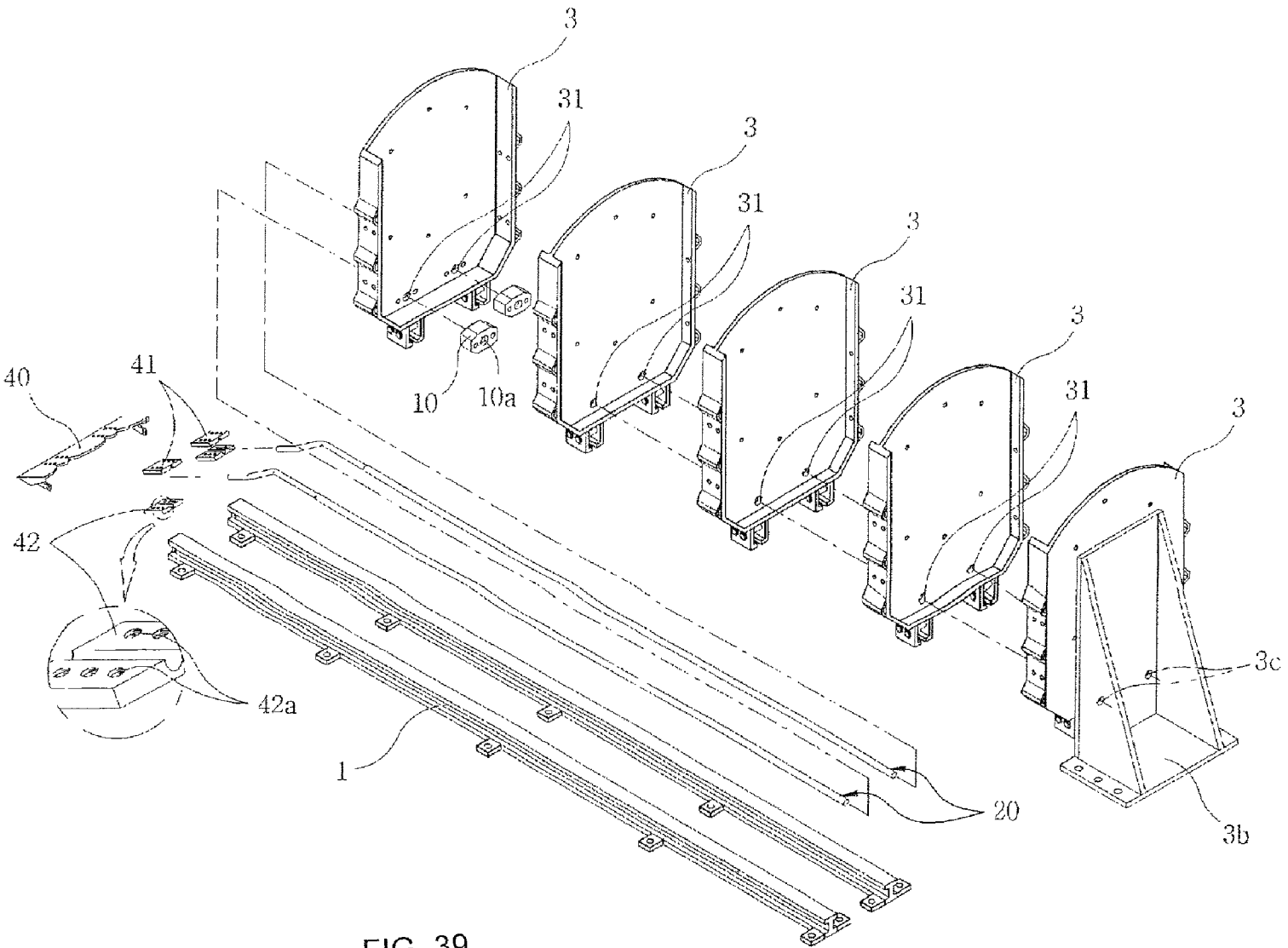
FIG. 39 is an exploded perspective view of the impact absorbing apparatus of FIG. 38.
Figure 40:
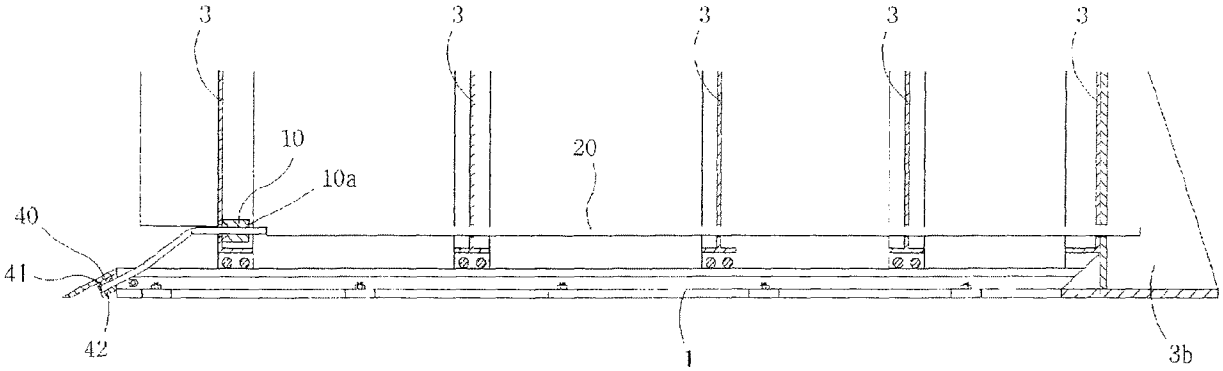
FIGS. 40 and 41 are side sectional views showing states of the impact absorbing apparatus of the third embodiment before and after a vehicle collides therewith, respectively.
Figure 41:
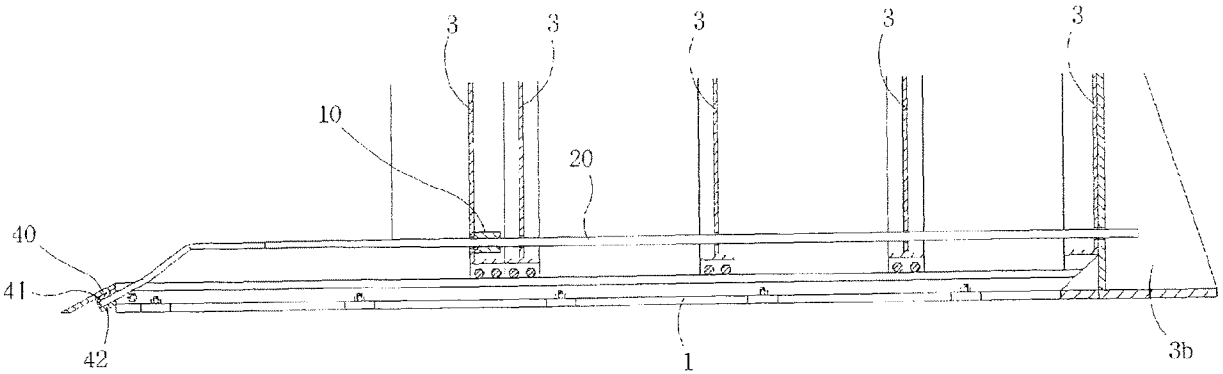
Figure 42:
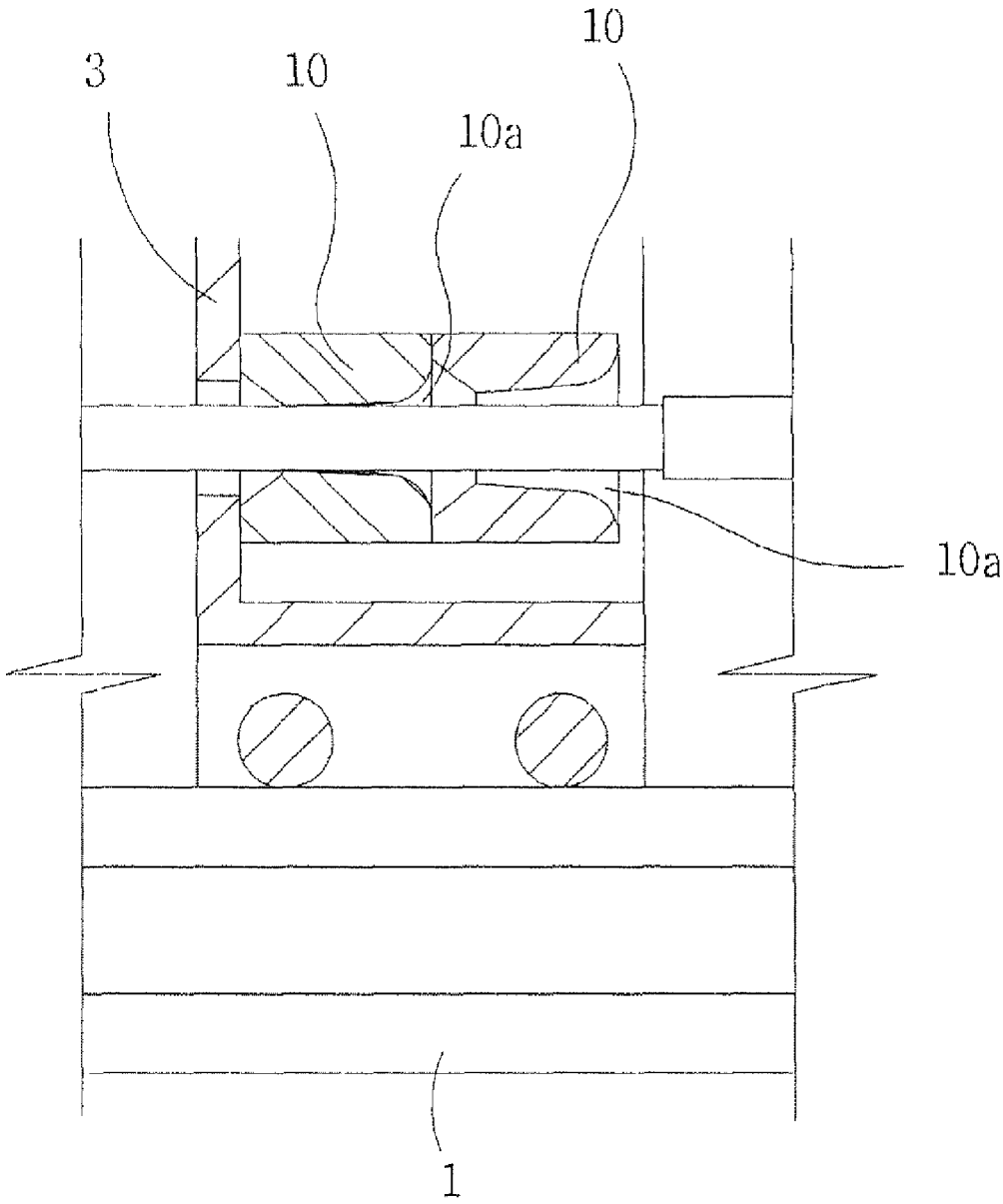
FIG. 42 is a side sectional view of a partition moving speed control member according to the present invention.

1: rail 2: ladder
3: partition 4: scrap tire
4*a*: opening 5: ladder holding device
5*a*: catch 10: partition moving speed control member
20: guide rod 41, 42: bracket
50: tool 120: locking rod

121: conical body part 122: stop part
130, 230: locker 131, 231: locker body
131*a*, 231*a*: through hole 131*b*, 231*b*: depression
132, 232: slider 133, 233: elastic member
134, 234: support plate 135, 235: slider stroke adjustment member
500: cover

The invention claimed is:

1. An apparatus for absorbing an impact of a vehicle collision, comprising:

at least two rails;

a plurality of partitions being moved along the at least two rails, the plurality of partitions including a frontmost partition and a rearmost partition relative to a direction in which a vehicle collides with the apparatus;

a plurality of scrap tires arranged in a line between the frontmost and rearmost partitions, each scrap tire having a plurality of openings defined therein, the plurality of openings being defined in a circumferential outer surface thereof, wherein the plurality of partitions are moved along the at least two rails in a direction in which the plurality of scrap tires are compressed during the vehicle collision;

an anchor provided on a lower end of at least one partition of the plurality of partitions, so that, when the vehicle collision occurs, the anchor is elastically locked to a ladder provided between the at least two rails;

a ladder holding device which holds the ladder and prevents the ladder from being moved before the vehicle collision occurs, the ladder holding device being manually releasable to expand the scrap tires, which are compressed, after the vehicle collision is over;

a partition moving speed control member provided in the frontmost partition that is disposed at a frontmost position relative to the direction in which the vehicle collides with the apparatus, the partition moving speed control member including an inner hole defined therein and having a predetermined inner diameter; and a guide rod inserted into the inner hole defined in the partition moving speed control member, wherein a front end of the guide rod is fastened to front ends of the at least two rails, and a free rear end of the guide rod extends through an insert hole, which is defined in each partition of the plurality of partitions, and is disposed at a rearmost position opposite the frontmost position, so that a part of the guide rod that is extended when the partition moving speed control member is advanced along the guide rod is prevented from being bent when striking one of the partitions.

2. The apparatus according to claim 1, wherein the partition moving speed control member has a double structure that includes a high strength insert, wherein a front inner surface of the high strength insert is rounded, and a rear inner surface of the high strength insert is inclined at a predetermined angle relative to a longitudinal axis extending through the partition moving speed control member.

3. An apparatus for absorbing an impact of a vehicle collision, comprising:

at least two rails;

a plurality of partitions being moved along the at least two rails, the plurality of partitions including a frontmost partition and a rearmost partition relative to a direction in which a vehicle collides with the apparatus;

a plurality of scrap tires arranged in a line between the frontmost partition and the rearmost partition, each scrap tire having a plurality of openings defined therein, the plurality of openings being defined in a circumferential outer surface thereof, wherein the plurality of partitions are moved along the at least two rails in a direction in which the plurality of scrap tires are compressed during the vehicle collision;

a partition moving speed control member provided in the frontmost partition disposed at a frontmost position relative to the direction in which the vehicle collides with the apparatus, the partition moving speed control member including an inner hole defined therein and having a predetermined inner diameter;

a guide rod inserted into the inner hole defined in the partition moving speed control member, wherein a front end of the guide rod is fastened to front ends of the at least two rails, and a free rear end of the guide rod is disposed intermediate a penultimate partition and the rearmost partition position;

a locking rod coupled to the free rear end of the guide rod such that a free rear end of the locking rod extends through the rearmost partition, the locking rod having a plurality of conical body parts and a plurality of stop parts; and a locker provided on an outer surface of the rearmost partition, through which the locking rod extends, such that, when the vehicle collision occurs, the locking rod freely passes over the locker, and, after the vehicle collision is over, the locking rod is prevented from being returned to an original position thereof by an expansive force of the plurality of scrap tires.

4. The apparatus according to claim 3, wherein the locking rod has an internal thread tap on a front end thereof, so that the locking rod is removably coupled to an external thread formed in the guide rod, in a rotating manner, and the free rear end of the locking rod has a cross-section configured to facilitate handling of the locking rod to return the plurality of partitions to the original position thereof after the vehicle collision is over.

5. The apparatus according to claim 4, wherein the cross-section of the free rear end of the locking rod has a configuration selected from among a triangular shape, a rectangular shape and a pentagonal shape to enable rotation of the locking rod to release the guide rod from the locking rod.

6. The apparatus according to claim 3, wherein the locker further comprises:

a locker body fastened to an outer surface of the rearmost partition, the locker body having a through hole defined therein and into which the locking rod is inserted, a depression, and a plurality of internal thread holes;

a slider provided in the depression and having an open inclined part which allows advancement of the locking rod, and a locking part which prevents the advanced locking rod from being moved in reverse;

an elastic member which provides an elastic force to the slider;

a support plate fastened to the locker body to prevent the elastic member from being removed from the locker body; and a slider stroke adjustment member extending through the support plate and which adjusts a range of a movement stroke of the slider.

7. The apparatus according to claim 3, wherein the locker comprises:

a locker body fastened to an outer surface of the rearmost partition, the locker body having a through hole defined therein and into which the locking rod is inserted, a depression, and a plurality of internal thread holes;

a pair of sliders provided in the depression, each slider having an open inclined part which allows advancement of the locking rod, and a locking part which prevents the advanced locking rod from being moved in reverse;

a pair of elastic members which provide an elastic force to the pair of sliders;

a pair of support plates fastened to the locker body to prevent the pair of elastic members from being removed from the locker body; and a pair of slider stroke adjustment members provided through the pair of support plates to adjust ranges of movement strokes of the pair of sliders.

8. The apparatus according to claim 3, further comprising:

a locking rod separating tool for releasing the guide rod from the locking rod to return the plurality of scrap tires, which are compressed by the vehicle collision, to original positions thereof after the vehicle collision is over.

9. The apparatus according to claim 4, further comprising:

a locking rod separating tool which releases the guide rod from the locking rod to return the plurality of scrap tires, which are compressed by the vehicle collision, to original positions thereof after the vehicle collision is over.

10. The apparatus according to claim 5, further comprising:

a locking rod separating tool for releasing the guide rod from the locking rod to return the plurality of scrap tires, which are compressed by the vehicle collision, to original positions thereof after the vehicle collision is over.

11. An apparatus for absorbing an impact of a vehicle collision, including a plurality of partitions to be moved along at least two rails when a vehicle collides therewith, the plurality of partitions including a frontmost partition and a rearmost partition relative to a direction in which a vehicle collides with the apparatus, the apparatus comprising:

a plurality of partition moving speed control members provided in the frontmost partition, wherein each partition moving speed control member has a double structure comprising a high strength insert, a rounded front inner surface, and a rear inner surface of which is inclined at a predetermined angle relative to a longitudinal axis extending through each partition moving speed control member;

a plurality of guide rods, wherein a guide rod is inserted into an inner hole defined in each corresponding partition moving speed control member, wherein front ends of the guide rods are fastened to front ends of the at least two rails, and free rear ends of the guide rods extend through respective insert holes defined in the rearmost partition, wherein when the vehicle collision occurs, each partition moving control member of the plurality of partition moving speed control members is advanced along the respective guide rod to absorb the impact of the vehicle collision; and a plurality of covers provided on upper ends of each partition, the covers being movable backwards in a direction going from the frontmost partition toward the rearmost partition along with the plurality of partitions when the vehicle collision occurs.

12. The apparatus according to claim 11, wherein the partition moving speed control members comprise:

first and second partition moving speed control members provided in the frontmost partition and provided on each of the plurality of guide rods in series to be movable along each guide rod, wherein the first and second partition moving speed control members have inner diameters different from each other, and wherein the second partition moving speed control member is disposed between the first partition moving speed control member and the rearmost partition and has an inner diameter greater than an inner diameter of the first partition moving speed control member.

13. The apparatus according to claim 11, further comprising:

a partition moving speed control member provided in at least one partition of the plurality of partitions other than the frontmost partition.

14. The apparatus according to claim 12, further comprising:

a partition moving speed control member provided in at least one partition of the plurality of partitions other than the frontmost partition.

* * * * *